US007494073B2

(12) United States Patent
Pivovarov

(10) Patent No.: US 7,494,073 B2
(45) Date of Patent: Feb. 24, 2009

(54) CLEANING OF SUBMERGED SURFACES BY DISCHARGE OF PRESSURIZED CAVITATING FLUIDS

(76) Inventor: Alexander Pivovarov, 2805 E. Oakland Park Blvd., Box 256, Fort Lauderdale, FL (US) 33306

( * ) Notice: Subject to any disclaimer, the term of this patent is extended or adjusted under 35 U.S.C. 154(b) by 232 days.

(21) Appl. No.: 11/299,091

(22) Filed: Dec. 9, 2005

(65) Prior Publication Data

US 2006/0151634 A1 Jul. 13, 2006

Related U.S. Application Data

(63) Continuation-in-part of application No. 11/071,143, filed on Mar. 3, 2005, now abandoned, which is a continuation-in-part of application No. 10/926,440, filed on Aug. 25, 2004, now abandoned, which is a continuation-in-part of application No. 10/396,981, filed on Mar. 25, 2003, now Pat. No. 6,883,731.

(51) Int. Cl.
*B05B 7/06* (2006.01)

(52) U.S. Cl. ..... 239/428; 239/433; 239/430; 239/468; 239/487; 239/501; 251/208

(58) Field of Classification Search ..... 239/424, 239/434, 526, 413, 430, 428, 463, 468, 471, 239/487, 500, 501; 251/208, 209
See application file for complete search history.

(56) References Cited

U.S. PATENT DOCUMENTS 2,200,587 A * 5/1940 Tirrell ..... 451/40
3,251,331 A * 5/1966 Crawford, III ..... 114/222
3,580,511 A * 5/1971 Hammelman et al. .... 239/419.5
4,372,242 A 2/1983 Lundberg
4,505,431 A 3/1985 Huffman
4,569,482 A 2/1986 Hiruma (Continued)

FOREIGN PATENT DOCUMENTS

RU 2076824 4/1997

(Continued)

*Primary Examiner*—Dinh Q Nguyen
(74) *Attorney, Agent, or Firm*—Malin Haley DiMaggio Bowen & Lhota, P.A.

(57) ABSTRACT

A fluid discharge apparatus adapted to discharge a cavitating stream of pressurized liquid along with the selective discharge of a secondary material, such as an abrasive, for removing dirt, debris, barnacles, marine growth, and other substances from submerged surfaces is provided. More particularly, the invention contemplates a introducing a pressurized liquid into a cavitation generating chamber to create and discharge a cavitating stream, and a secondary inlet for injecting abrasive material, such as silica, into the chamber to improve cleaning effectiveness. The gas bubbles within the cavitating liquid stream that essentially explode upon impacting debris resulting in tremendous pressure fluxuations provides improved effectiveness in removing debris and aquatic growth from the submerged surface. The combination of a secondary substance, such as an abrasive material, foam, or compressed gas enhances cleaning effectiveness. The invention further improves upon the control of such devices with controls, such as a pistol grip or rotational grip controllers, that allow the diver/operator to adjust flow rates and thrust without releasing his grasp. An improved hand-held apparatus is disclosed with a pistol grip and trigger actuator, and an improved wheeled vehicle is disclosed with improved control handles adapted to actuate valves and closure ports.

8 Claims, 28 Drawing Sheets

U.S. PATENT DOCUMENTS

| | | | | | |
|---|---|---|---|---|---|
| 4,716,849 | A | * | 1/1988 | Conn et al. | 114/222 |
| 5,048,445 | A | | 9/1991 | Lever | |
| 5,221,026 | A | | 6/1993 | Williams | |
| 5,779,523 | A | * | 7/1998 | Mesher | 451/93 |

FOREIGN PATENT DOCUMENTS

| | | |
|---|---|---|
| RU | 2095274 | 11/1997 |
| RU | 2168440 | 6/2001 |
| RU | 2168441 | 6/2001 |
| RU | 2002 125729 | 9/2002 |
| RU | 27 559 | 2/2003 |
| RU | 27 560 | 2/2003 |
| RU | 28 669 | 4/2003 |
| RU | 29026 | 4/2003 |
| RU | 29027 | 4/2003 |
| WO | WO 01/10577 | 2/2001 |

* cited by examiner

Flow chart of process

CLEANING OF SUBMERGED SURFACES BY DISCHARGE OF PRESSURIZED CAVITATING FLUIDS

CROSS REFERENCE TO RELATED APPLICATIONS

This application is a continuation-in-part of U.S. patent application Ser. No. 11/071,143, filed on Mar. 3, 2005, which is a continuation in part of U.S. patent application Ser. No. 10/926,440, filed on Aug. 25, 2004, which is a continuation-in-part of U.S. patent application Ser. No. 10/396,981, filed Mar. 25, 2003.

STATEMENT REGARDING FEDERALLY SPONSORED

RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

The present invention relates generally to fluid discharging apparatus, and, more particularly, to an apparatus and method of cleaning submerged surfaces with cavitating fluids.

2. Description of the Background Art

Various devices exist for dispensing mixtures of liquids and pressurized gas. Such devices are commonly used in pressure washing, the application of liquid fertilizers, snow making, foam making, as well as a variety of other applications. These prior art devices are generally characterized as having inlet ports for receiving the fluids, internal mixing chambers for commingling the fluids, and at least one outlet port for discharging the fluids. In addition, various devices exist for surface cleaning. With regard to this invention, all the abovementioned devices can be easily divided for three groups:

1. Water jet cleaning devices. This group of devices are successfully operated all over the world. (See U.S. Pat. Nos. 5,048,445; 4,716,849; 4,372,242; 5,979,012; 5,893,188; 5,898,970; 5,933,899; 6,003,184; 6,584,992; 5,090,619). In spite of advantages of implementation of those inventions, those devices required serious development and new design.
2. Devices with the implementation of cavitations and/or pulsation water streams, with the common purposes, like drills, scientific and research, feasibility studies, etc (See U.S. Pat. Nos. 4,262,757; 4,389,071; 4,474,251; 4,508,577; 4,681,264; 5,500,134; 6,200,486; 6,221,260). Those inventions are very specific and because of lot disadvantages, have no implementation in practice.
3. Devices with the implementation of cavitations streams for cleaning and other practical purposes. (See RU PATENTS: 2,168,440; 2,168,441; 2,076,824; 2,095,274; RU Published application: 2002,125,729; Certificates for the useful models: 27,559; 27,560; 28,351; 28,669; 29,026; 29,027.) Those devices are in very good efficiency, but they are still have to be serious developed.

The prior art reveals an apparatus developed for use in cleaning underwater surfaces (RU Patents 2,076,824; 2,095,274). RU Patent No. 2,168,441 (also identified as WO 01/10577 and PCT/RU99/00278) discloses a Hydrodynamic Tool for Surface Cleaning. That device comprises a hand-held device having a pistol grip connected to a source of pressurized water and a barrel section having a nozzle adapted for generating cavitation in flowing fluid discharged therefrom. The device is used to discharge a pressurized stream of water with cavitation generated gas bubbles to assist in removing debris and biological matter that has accumulated on various submerged surfaces.

RU Patent No. 2,168,440 (also identified as WO 01/10576 and PCT/RU/00277) discloses a wheeled configuration for discharging pressurized stream of water with cavitation generated gas bubbles to assist in removing debris and biological matter that has accumulated on various submerged surfaces. The wheeled configuration comprises a generally saucer shaped device wherein a pair of cavitation nozzles are disposed arms pivotally connected to the underside of the device. The wheeled device is maneuvered over a submerged surface by a diver while the spinning cavitation nozzles discharge a pressurized stream of water with cavitation generated gas bubbles to assist in removing debris and biological matter that has accumulated on various submerged surfaces.

The two specifically referenced devices of the prior art, however, are each burdened with similar disadvantages. More particularly, both the hand-held and wheeled devices are limited to discharging cavitating water flow, and are not adapted for the additional discharge of a an abrasive material, such as sand, for more effective removal of debris and marine growth from submerged surfaces. In addition, each of the specifically referenced devices include control levers that have proven difficult to manipulate by an operator in a diving suit.

Accordingly, there exists a need for an improved fluid discharging apparatus wherein cleaning effectiveness is improved by discharging a cavitating stream of pressurized fluid along with a granular abrasive material, such as sand. There further exists a need for such apparatus wherein improved control mechanisms simplify operation.

Features and Advantages

Portions of sea going vessels that are disposed below the waterline, such as the hull surfaces, screw-steering groups, sea chest screens and boxes, are prone to paint peeling, corrosion, and overgrowth of animal and plant organisms. As a result, the vessel experiences increased hydrodynamic drag that results in deterioration of operational specifications and inefficient fuel consumption. It is known that the accumulation of biological growth on a vessels hull of a mere 1 millimeter can increase fuel consumption by approximately one percent (1.0%). It has further been found that the hull of a vessel may accumulate biological growth of approximately in the northern seas 3-5 kg/sq.m and more than 50 kg/sq.m in tropical seas with biological growth reaching up to 20.0 cm. By way of example, an ocean going tanker of 270 tones displacement traversing between the Persian Gulf and Europe may suffer continuous decreases in speed from 17 knots to 14 knots after two years of operation without cleaning. As a direct result, the power plant must operate at higher power thereby substantially increasing fuel consumption.

Losses realized by the owner of a vessel after operating for 2 years without biological growth cleaning, assuming a fuel price of $470.00 U.S. per ton are as follows:

Ocean-going freighters are normally cleaned in dry docks. However, dry dock cleaning is expensive and thus must usually be deferred and coordinated with other scheduled repair works. In recent years, technology has been developed to permit the regular underwater cleaning of a vessel without requiring that the vessel be dry docked. As a rule, the economic benefit of such cleaning is very high. The regular cleaning of portions of the hull below the water line of a tanker of 50 thousand tons displacement during the interdock period after one year of its operation saves 950 tons of diesel, i.e. up to $446,500 U.S. An overgrowth of animal and plant organisms on hydraulic structures may further degrade operation of those structures. For example, such overgrowth has a negative impact on heat exchanger efficiency, the operation of underwater pipelines, and cooling water inlets and outlets for power electric stations. In addition, by creating substantial drag, overgrowth can destroy sea based oil platforms, while making underwater inspections and salvage works on underwater surfaces of bridges and other hydraulic engineering structures difficult if not impossible.

The common method of cleaning hydraulic engineering structures with very high-pressure water sprays is extremely dangerous to divers, expensive, and time consuming.

The present invention enables to clean with water while underwater and is absolutely safe for divers and environment.

The Cavitations Phenomena

The destructive force of cavitations is well known as an enemy of mankind. In aviation, marine, and other industries cavitations damage propellers, turbines, pumps, etc.

The first recorded attempts at understanding cavitations are credited to inventor Michelangelo (1475-1564), who proposed filling "water cavities" in mountain pipelines with sand. Most efforts directed to solving problems related to cavitation focus on force reduction.

According to S. A. Kinnas, cavitation is an undesired phenomena in hydraulic systems. Cavitation often occurs in the suction part of a hydrodynamic system. When cavitation occurs, the pressure in the fluid decreases to a level below the ambient pressure thus forming "vacuum holes" in the fluid. When the pressure increases, for example in a pump, these "vacuum holes" implode. During this implosion the pressure increases tremendously and the temperature rises to about 1100° C. The high pressure in combination with the high temperature is capable of causing substantial damage to hydraulic components. For example, a cavitating pump might be completely damaged in several hours and the wear parts may cause damage in the system. (illustration 1).

Useful Applications of Cavitations Destructive Force

The present invention is useful in cleaning biological growth from vessel hulls using hydrodynamic cavitating jets without requiring that the vessel be confined to a dock. This technology allows for easy and quick cleaning of any floating equipment, hydraulic engineering structures, including sea oil extracting platforms, bulk-oil moorings, piers, pipelines, etc.

The equipment is designed to use the destructive effects of hydrodynamic cavitating jets. The basic part of the equipment is the cavitating jet generator using water pressurized to 75-150 bar. The cleaning process includes a booster pump to send outboard water to a high-pressure pump through a mesh filter. Water exits the high-pressure pump and enters a pistol or head via a high pressure hose whereby the water is turned into high-speed cavitating jet. When the cavitating jet is directed onto a surface to be cleaned, gas bubbles meet the obstacle, biological growth or rust, and burst. As the bubbles burst, micro explosions cause the pressure to increase up to ten thousand atm. This causes the destruction of biological growth and blasts the refuse products out of the working area.

Fragile cement deposits are especially easy to be destroyed. The hydro jet force moves a diving water-jet head around the surface being cleaned, while the high pressure cavitating jet clears the area from nozzles placed on a revolving rotor.

The control over cleaning process quality and measuring of the cleaning surface thickness, if necessary, can be done with the help of TV camera and ultrasound underwater thickness indicator.

Systems

The Cleaning Systems and specific underwater cleaning equipment are designed for a fast pace and thorough cleaning, while being gentle enough to surface coatings of ships as well as hydraulic engineering structures. The Cleaning Systems are capable of completely removing biological growths and rust, core fouling grass, shell, coral, small and large barnacles, deposits, marine vegetation from such structures. These Systems are perfect for cleaning ships, submarines, sea and river port structures, hydraulically engineered sea oil platforms, bulk-oil moorings, piers and pipelines. Paint, sealants and coatings are easily removed by using the power cavitating jets commingled with water spray. By changing the mode of nozzle operation (pressure, distance up to a surface, angle of nozzles slope, the period of jets effect etc.) it is possible to do qualitative cleaning of a surface not only from growths, but also from friable rust, and old paint without destroying the basic paint covering, or, if necessary, reaching even the "white metal" (before installing a vessel into a dock for the painting). If the layer has already degraded, it is possible to remove it together with the rust.

Hand-Held Sub-Marine Power Cleaning Pistol

The power-cleaning pistol is a manual tool used for underwater cleaning of surfaces to remove deposits, rust, marine vegetation, as well as paint, sealants and etc. This tool is especially adapted for difficult cleaning jobs like a ship's sea hest screens, screw-steering group, and other areas difficult to reach e.g., electric power station's heat exchangers, sewer collectors, underwater pipelines and etc. Operating condition to work in the sea: * Light day; * Sea State up to 2.

Self-Propelled Sub-Marine Power Cleaning Head

The power cleaning head is a tool being used for underwater cleaning of surfaces to remove deposits, rust, marine vegetation, as well as paint, sealants and etc. The hydro jet force moves the diving water-jet head around the surface being cleaned, while the cavitating jet clears debris from the area in proximity to the head. The head is kept on a surface by the hydro dynamical suction force resulting from rotor revolutions. In addition, the head may be equipped with magnetic wheels. Another option—remote controlled robotic head that can be used where a large surface has to be cleaned or where there is danger to the divers. This tool is especially good for fast underwater wide path cleaning such surfaces as ship's hulls and underwater large pipelines and etc. Operating condition to work in the sea: * Light day; * Sea State up to 2.

Comparison

The only other effective method involves the use of divers equipped with scrapers or mechanical brushes with a cleaning productivity from 5 up to 200 sq.m per hour at the cost of cleaning up to $25.00-30.00 U.S. per 1 sq.m of a vessel's underwater surface. Power pneumatics or fluid drive is applied in those manual mechanisms. The productivity of the unit with the revolving brushes is higher comparing to the manual scrapers cleaning, although it has considerable defects:

- impossibility to remove the biological growth thicker than 10 mm;
- blockage of the brushes with the cleaning wastes, especially seaweeds;
- need for periodical stops to clean the brushes;
- quick deterioration of the brushes;
- demolition of the varnish-painted layer, especially by the metal brushes;

impossibility to clean the sea chests, screw-steering group, after-body and front part of the vessel.

The difficulty of mechanical cleaning is increased by the fact that the divers must scrape and beat off growths coat by coat where the growth is thick, and the layers stick together with the strength of concrete.

The present invention overcomes those disadvantages because the tools work "under the root" of barnacles and rust, and the cleaning speed is much higher and of improved quality.

The advantages of present invention over the method of a diver using a manual scrapper or mechanical brushes to implement the job are obvious. The speed and thoroughness of the present invention is unparalleled (table 1).

Environment

At the present time hundreds and hundreds of divers all over the country clean underwater structures and equipment with scrapers, brushes or with very high pressure (up to 40 000 psi) water sprays. All these methods bring additional pollutants to the environment because of the nature of their technologies. The present invention gives the opportunity to clean any floating equipment or other hydraulic engineering structures whether at sea, in rivers or ports while being extremely gentle to the surface coatings. During mechanical cleaning divers must scrape and beat off growths together with coatings (paints, etc.). The present invention has no such drawbacks because the tools work "under the root" of barnacles and rust and there are no additional pollutants involved, because the Systems are adjusted such a way in order not to destroy or damage the smooth surfaces to be cleaned (paints, etc.). The Systems only remove the biological organisms, adding food for underwater inhabitants. The technology is completely safe for the environment and divers.

BRIEF SUMMARY OF THE INVENTION

The present invention improves upon the prior art devices by providing an improved fluid discharge apparatus adapted to discharge a cavitating stream of pressurized liquid along with the selective discharge of an abrasive material, such as sand, for removing dirt, debris, barnacles, marine growth, and other substances from surfaces. More particularly, the invention contemplates adapting the cavitation chamber with auxiliary inlets for introducing and discharging abrasive material, such as silica, to improve cleaning effectiveness, and/or a compressed gas or foam depending on the application. The combination of a secondary fluid or abrasive substance in an upstream position prior to formation of the cavitation results in a cavitating stream having bubbles that essentially explode upon impacting debris resulting in tremendous pressure fluxuations along with a secondary substance, such as an abrasive substance that provides improved effectiveness in removing debris and aquatic growth from the submerged surface. The present invention further includes a third inlet downstream from the second inlet for selective introduction of additional substances into the cavitating stream.

The present invention thus provides underwater cavitation cleaning technology and equipment that is useful in cleaning: hydroelectric dams; intake structures; pipeline crossings; bridges; locks and dams; water and wastewater facilities; outfalls; pipelines of nuclear reactors; spent fuel pools; underwater salvage and demolition; oil platforms; ship hulls, propellers, etc.; submarines, with no side effects. It is also useful: in aviation industry to remove the scurf, calx, rust and paint from blades of turbines and compressors; in metallurgical industry to clean plates after flatting; in oil and oil-refining industry to clean tanks, cisterns, well cleanup; in housing and communal services to clean of sewer collectors and tubings; in health care industry to provide intensive physiotherapy procedures; for fire distinguishing.

The present invention further provides improvements in the operation and control of said devices by providing ergonomic controls.

Accordingly, it is an object of the present invention to provide an improved hydrodynamic tool for use in removing debris and marine growth from submerged surfaces.

Still another object of the present invention is to provide a fluid handling apparatus for discharging dual streams, including a cavitating stream of pressurized liquid and a pressurized abrasive.

Still another object of the present invention is to provide an improved method of cleaning surfaces using a pressurized spray.

A further object of the present invention is to provide an improved method of cleaning marine deposits from submerged surfaces.

Yet another object of the present invention is to provide hydrodynamic cleaning apparatus adapted with easy to use controls.

In accordance with these and other objects, which will become apparent hereinafter, the instant invention will now be described with particular reference to the accompanying drawings.

DETAILED DESCRIPTION OF THE INVENTION

Figure 1:
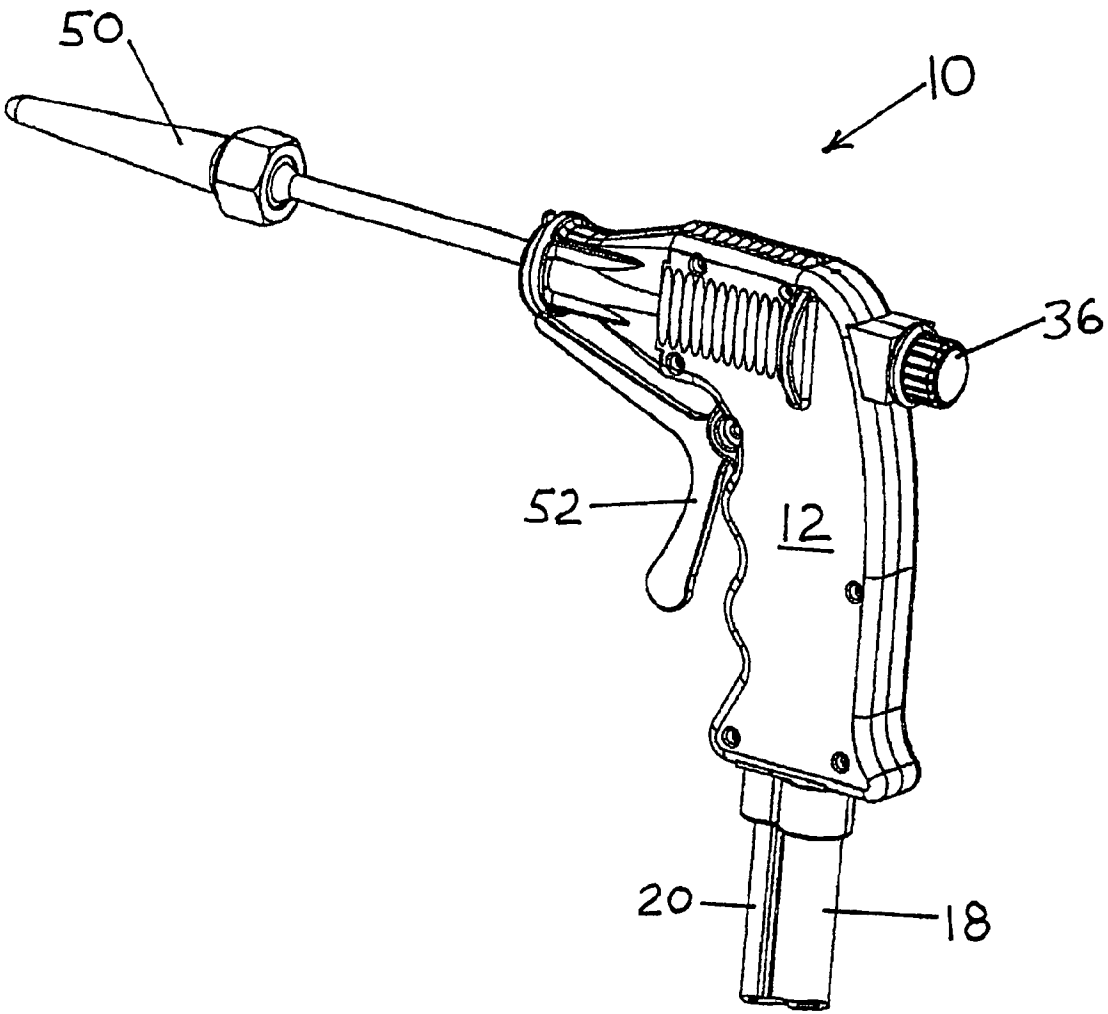
FIG. 1 is a perspective view of a fluid discharge apparatus according to the present invention.
Figure 2:
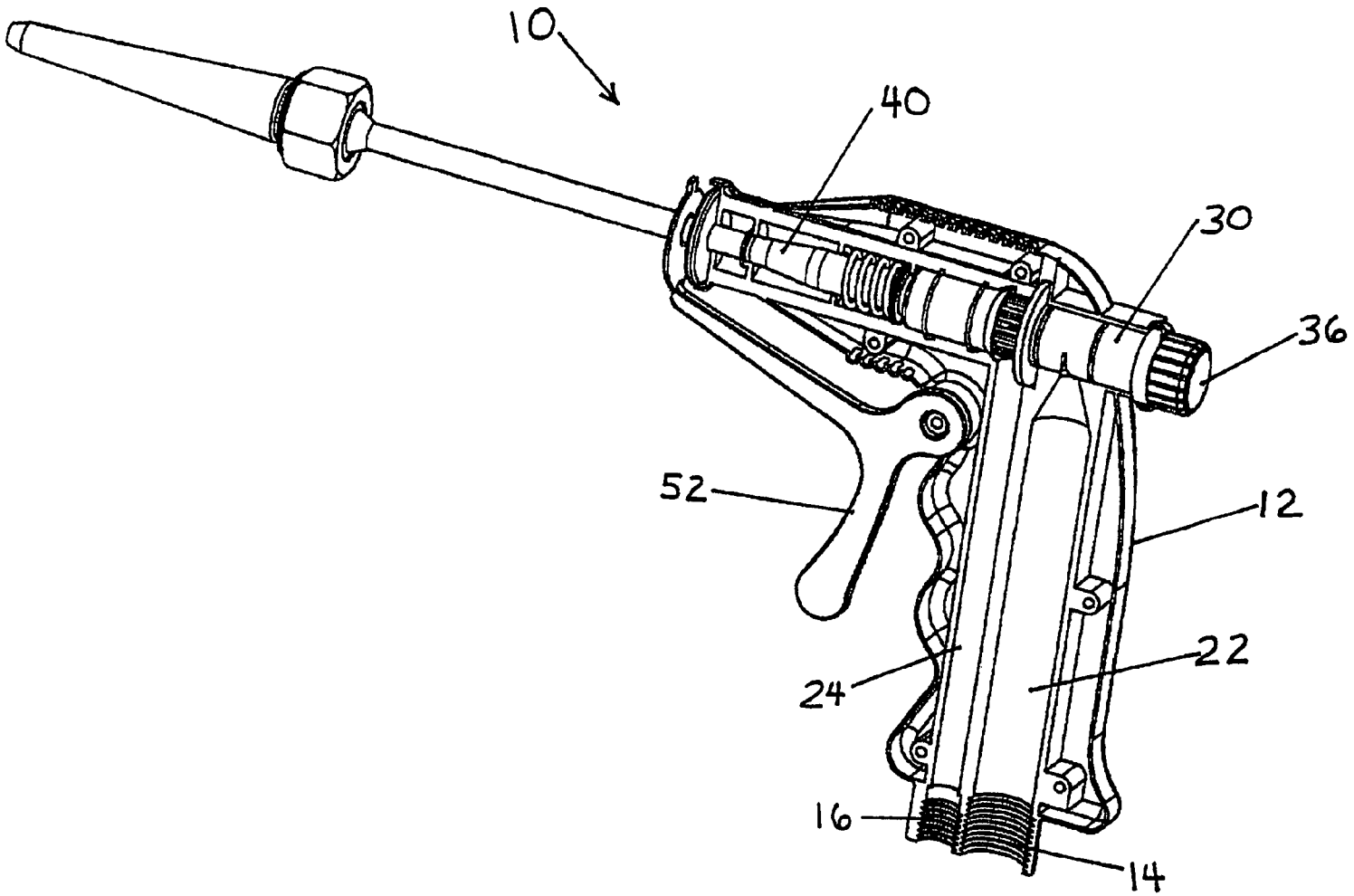
FIGS. 2-5 are partial cross-sectional views thereof.
Figure 3:
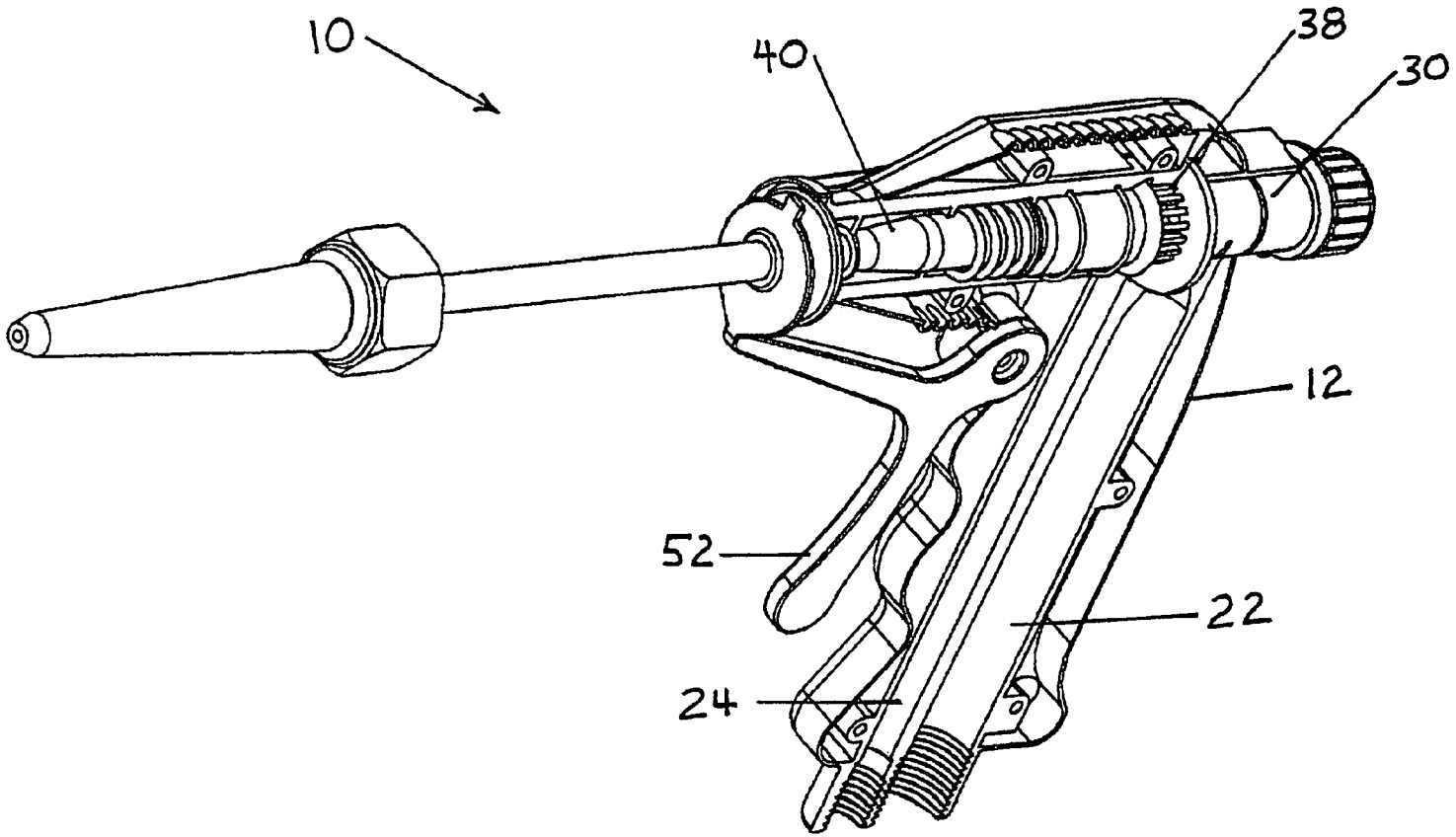
Figure 4:
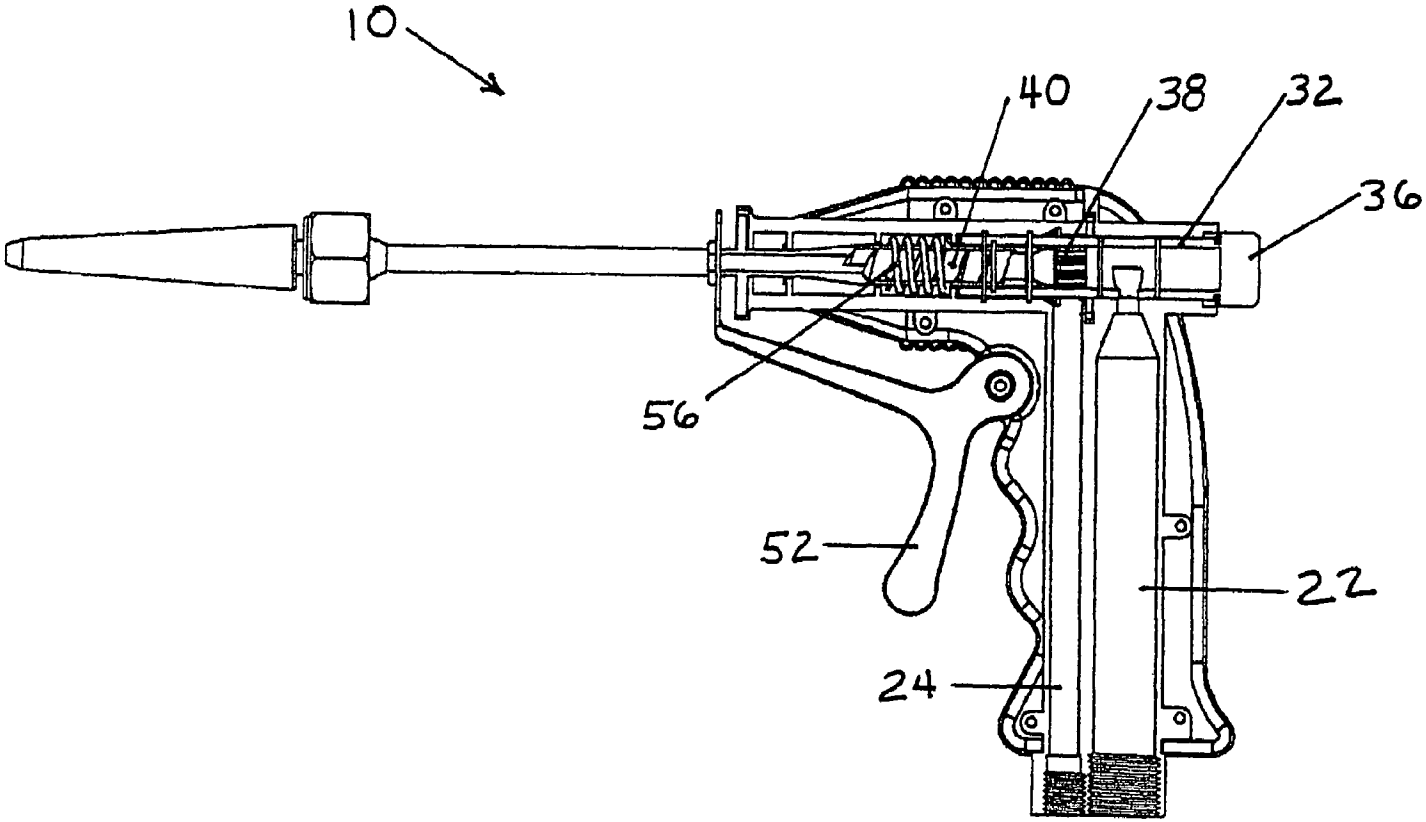
Figure 5:
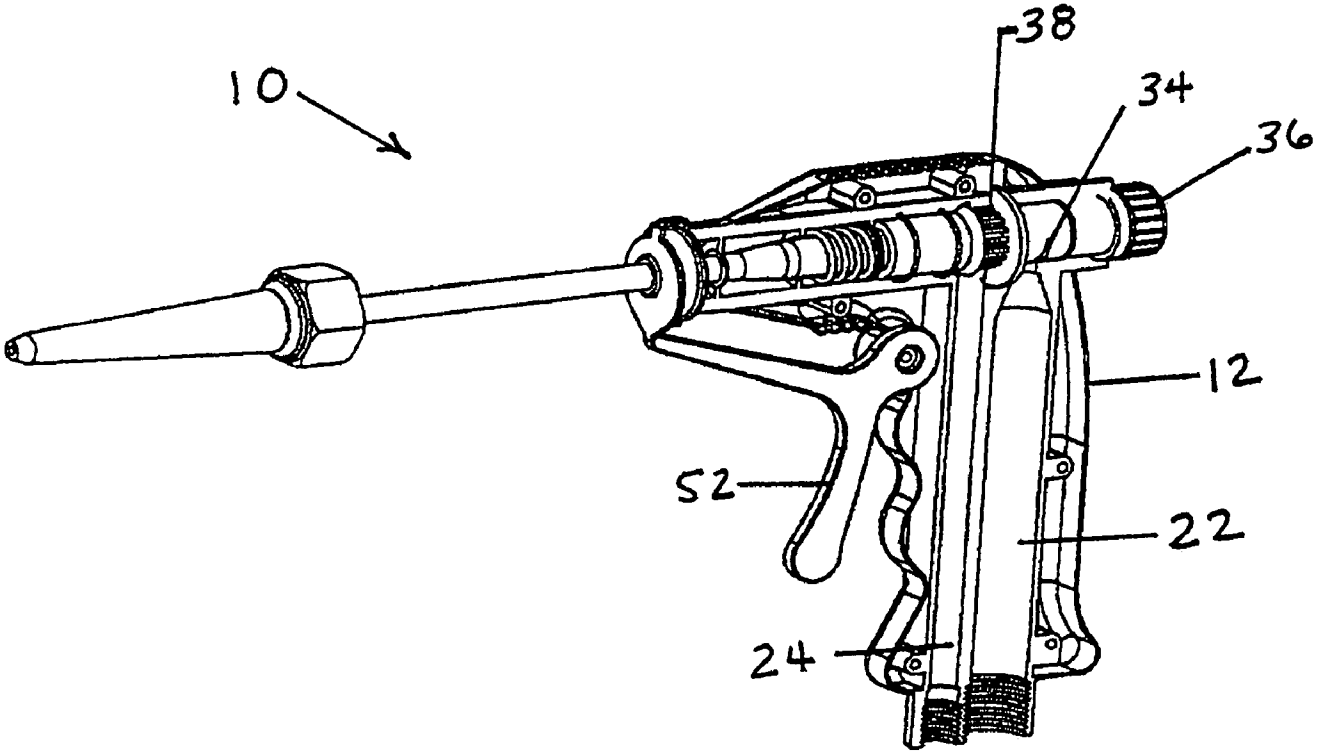
Figure 6:
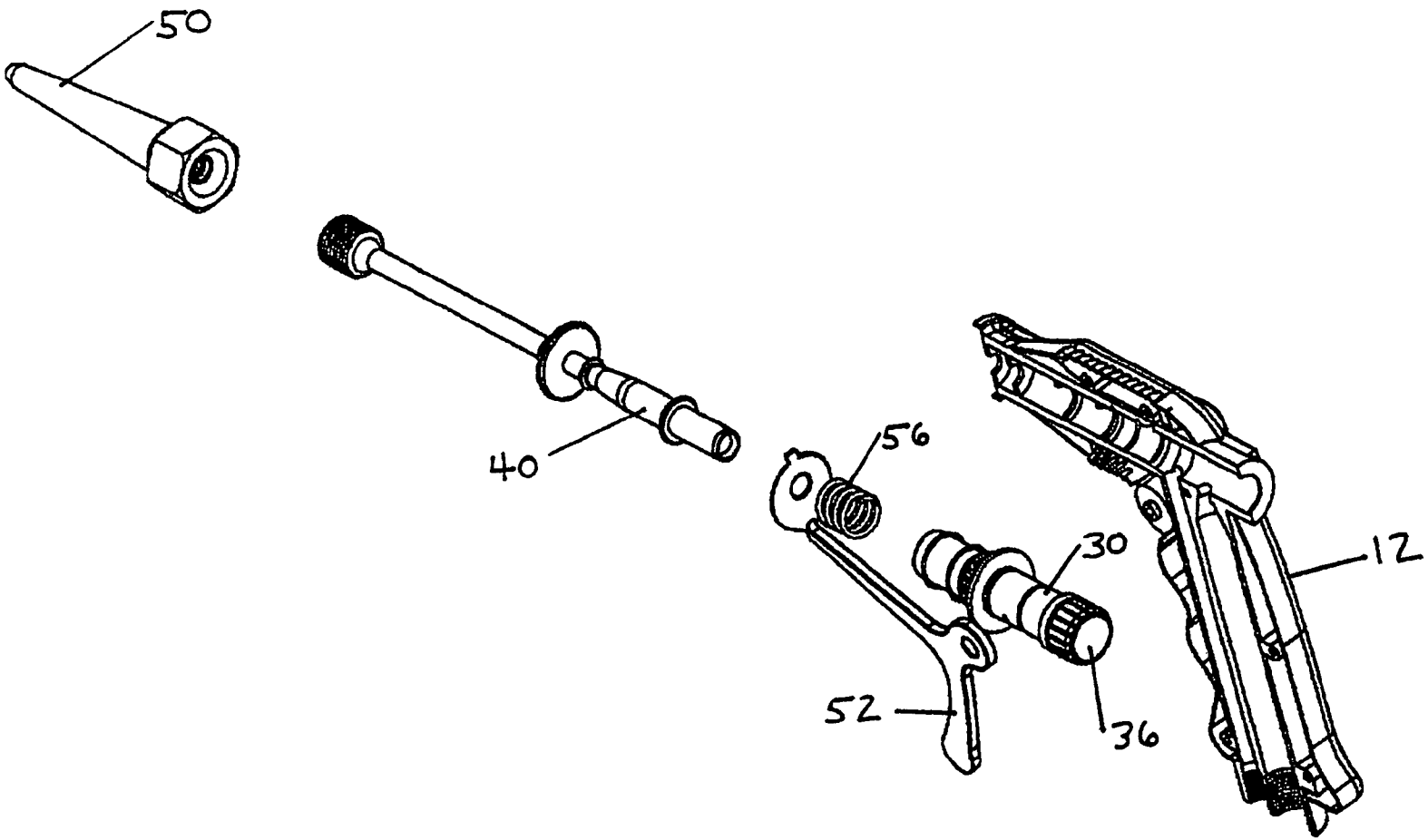
FIGS. 6 and 7 are exploded views thereof.
Figure 7:
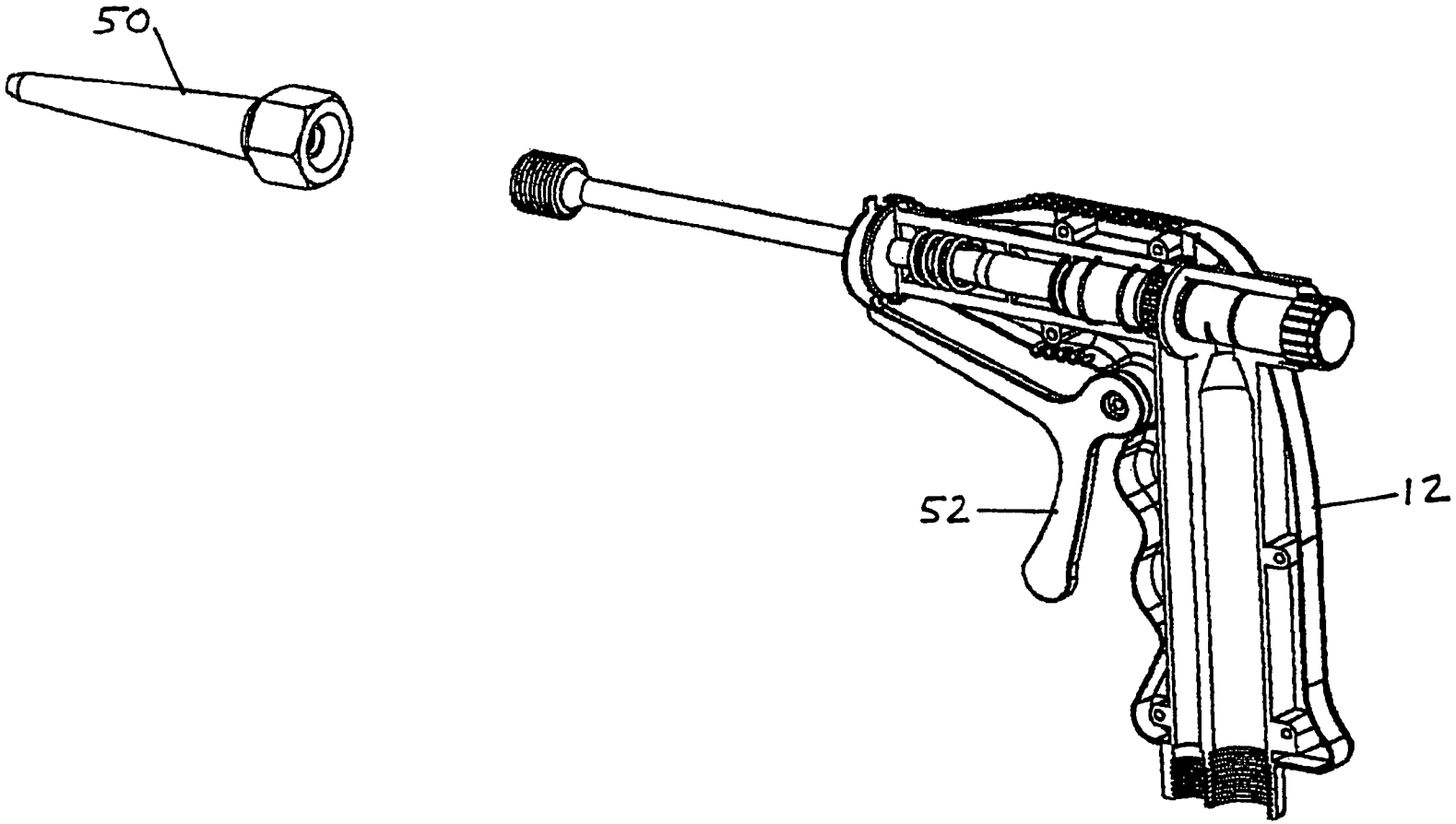
Figure 8:
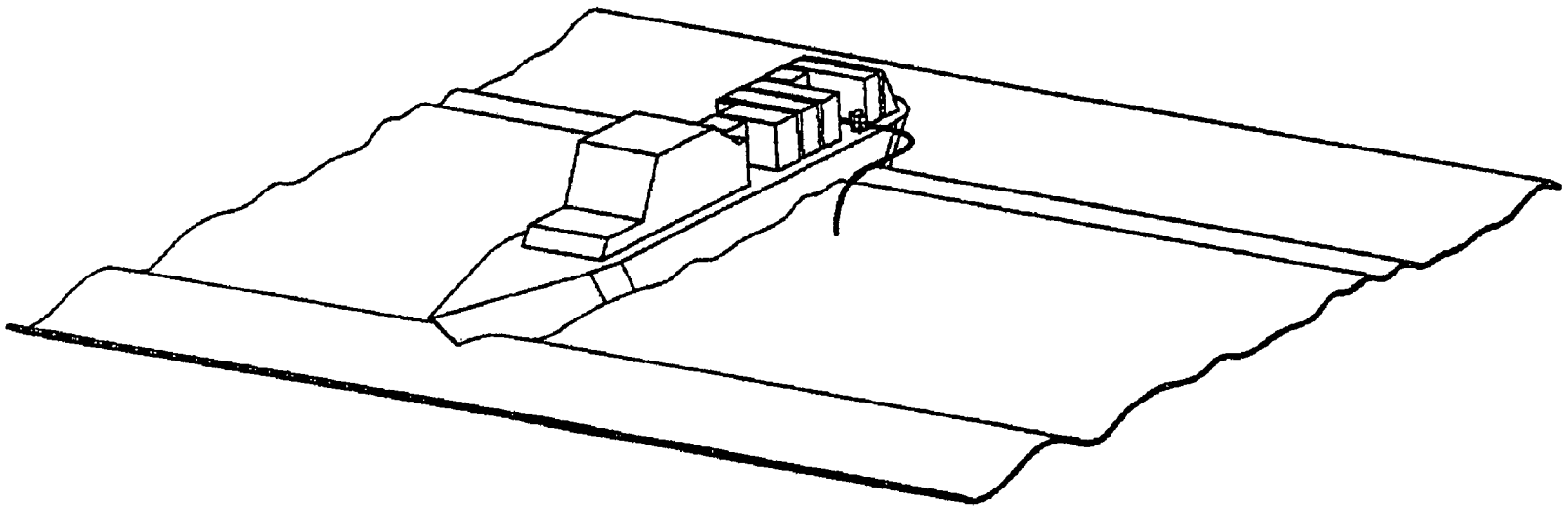
FIGS. 8-11 illustrate use of the fluid discharge apparatus in a marine environment to clean the hull of a marine vessel.
Figure 9:
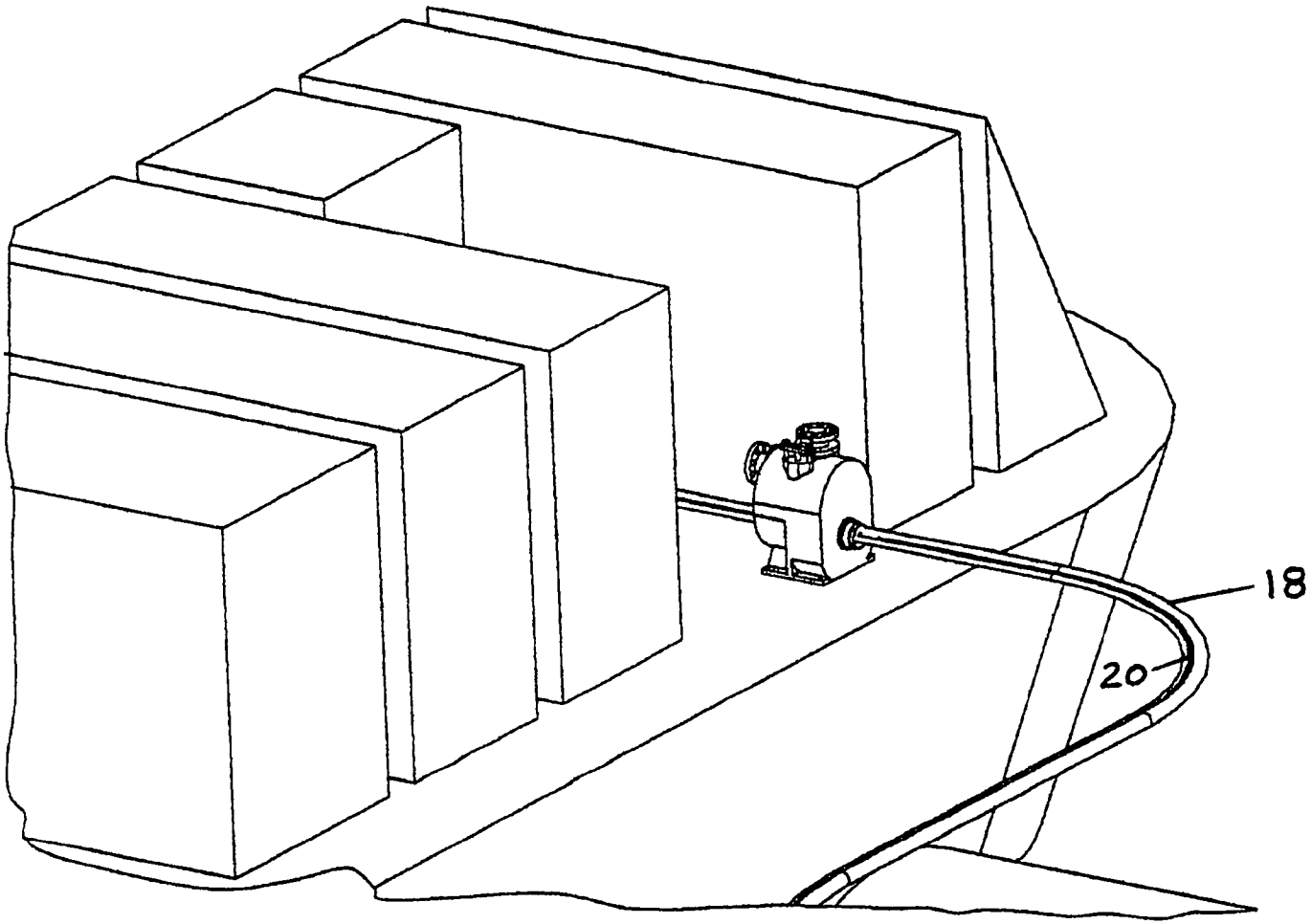
Figure 10:
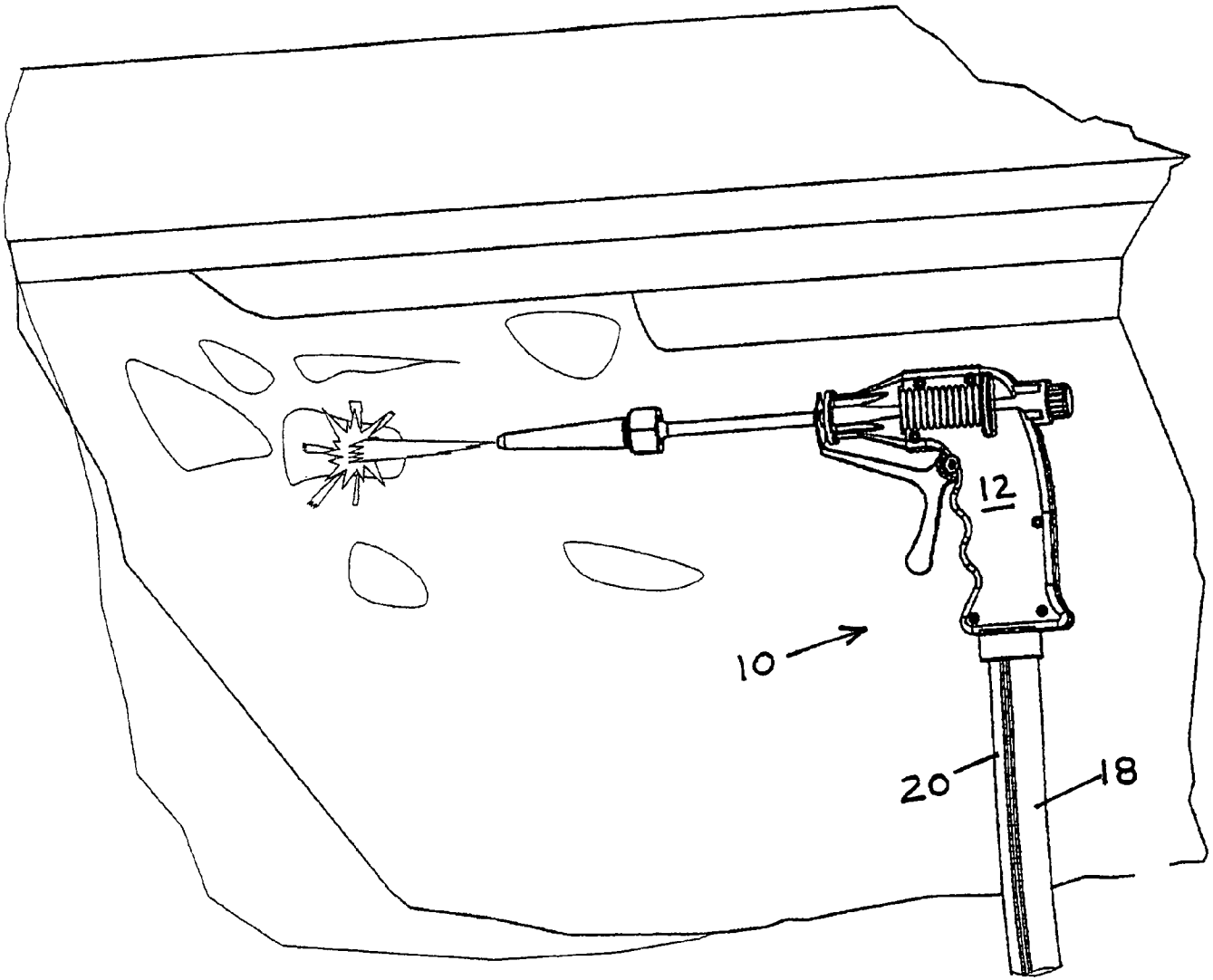
Figure 11:
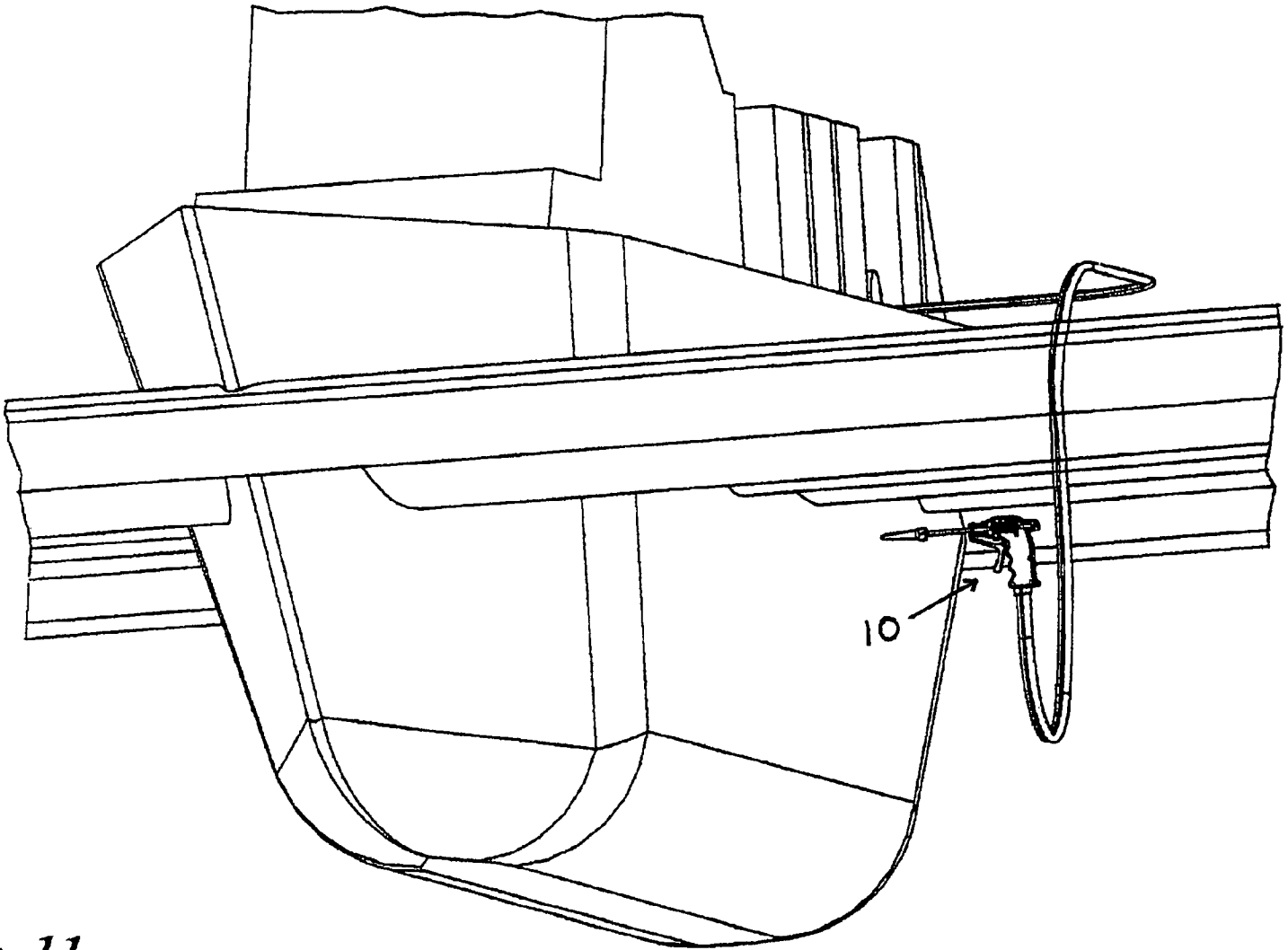
Figure 12:
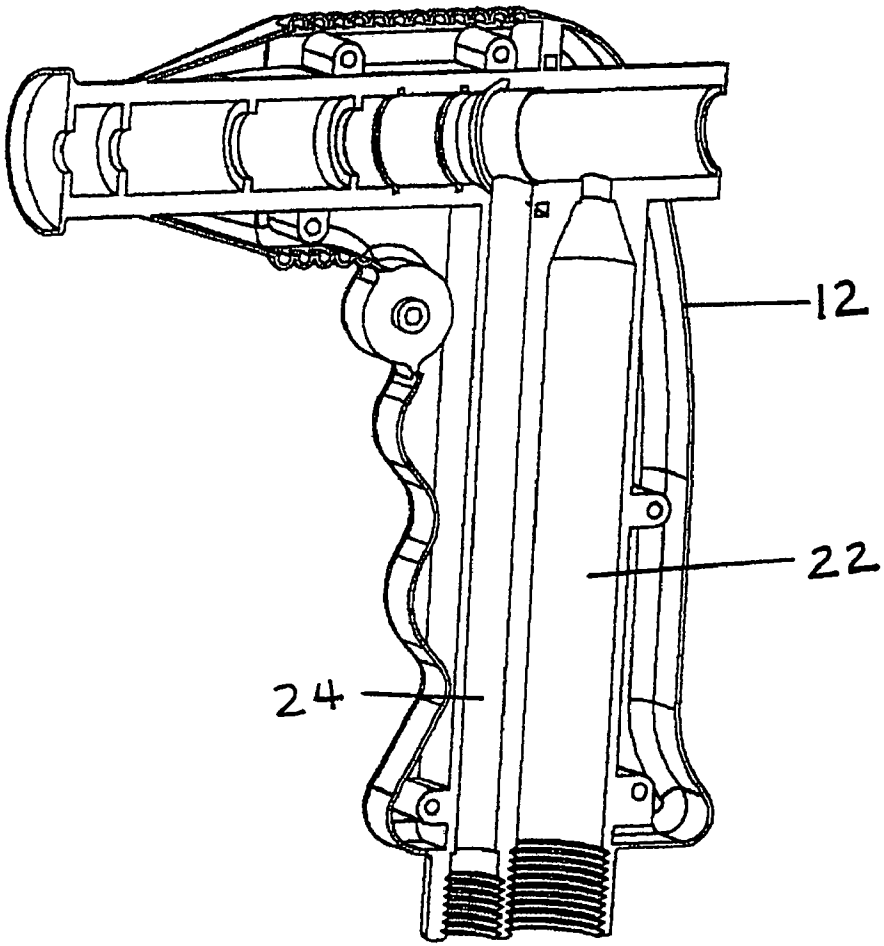
FIG. 12 is a cross-sectional view of the handle forming housing.
Figure 13:
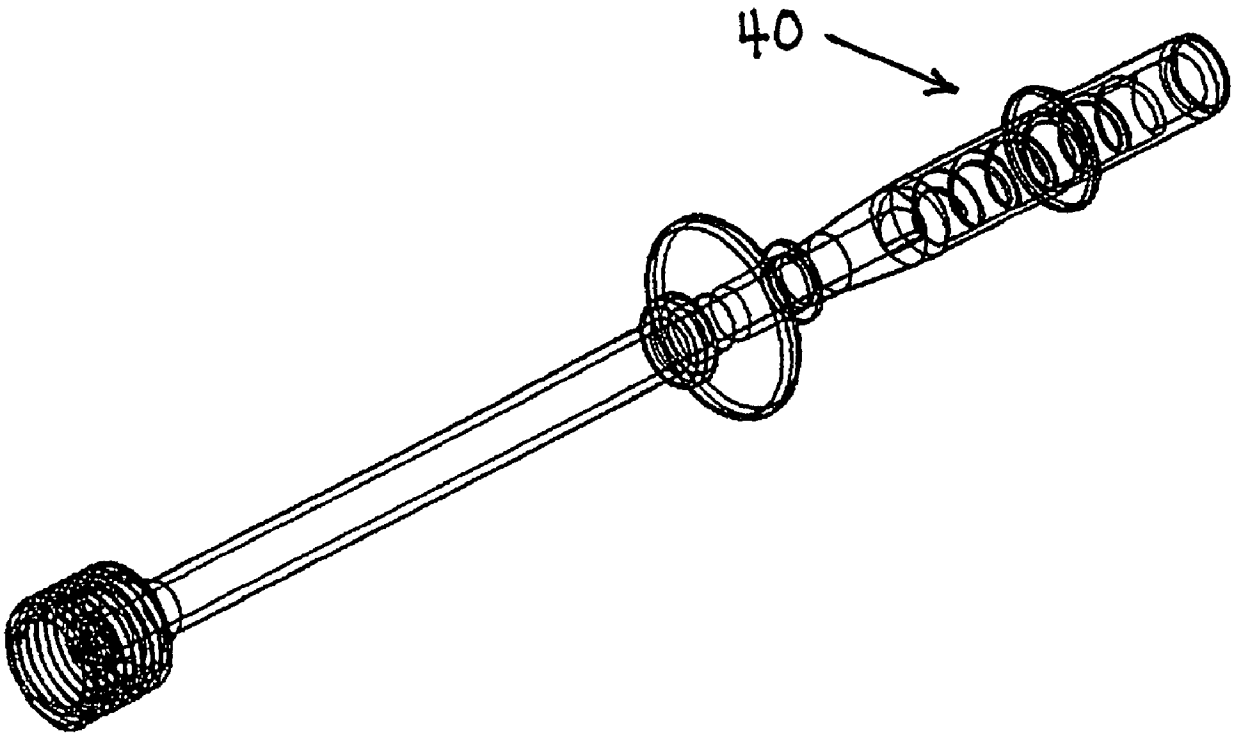
FIG. 13 is a perspective transparent view of the barrel section of the fluid discharging apparatus.
Figure 14:
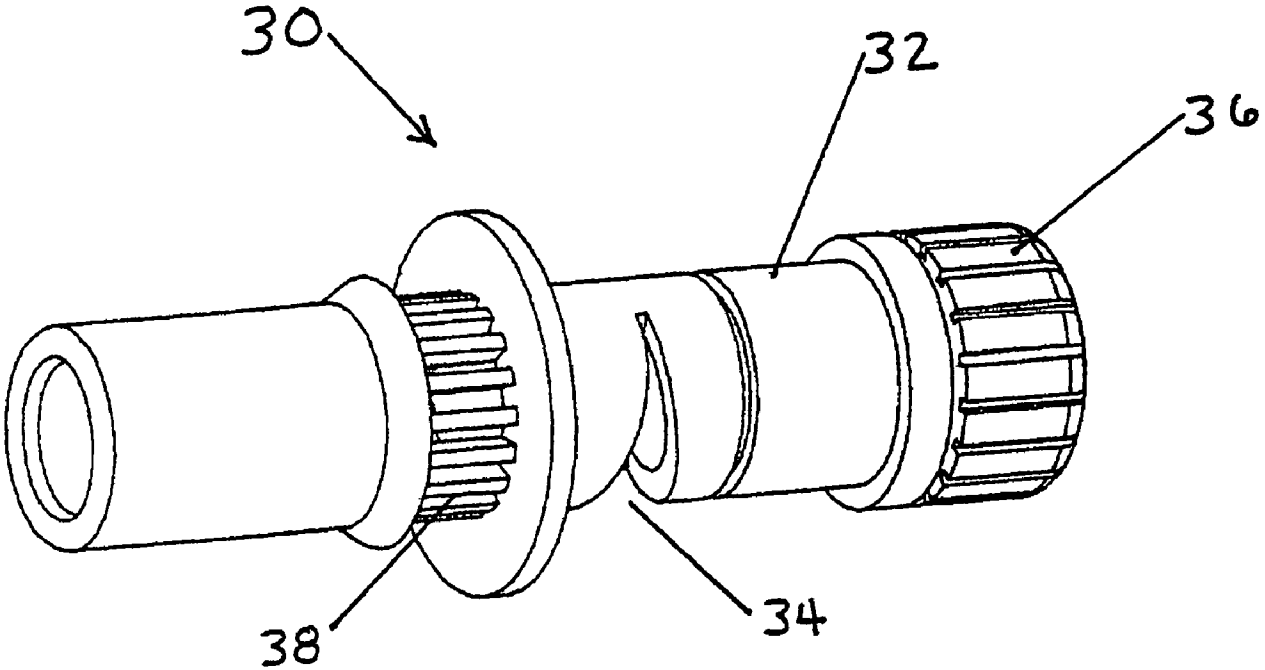
FIG. 14 is a perspective view of a fluid handling component adapted for engagement with the barrel section.
Figure 15:
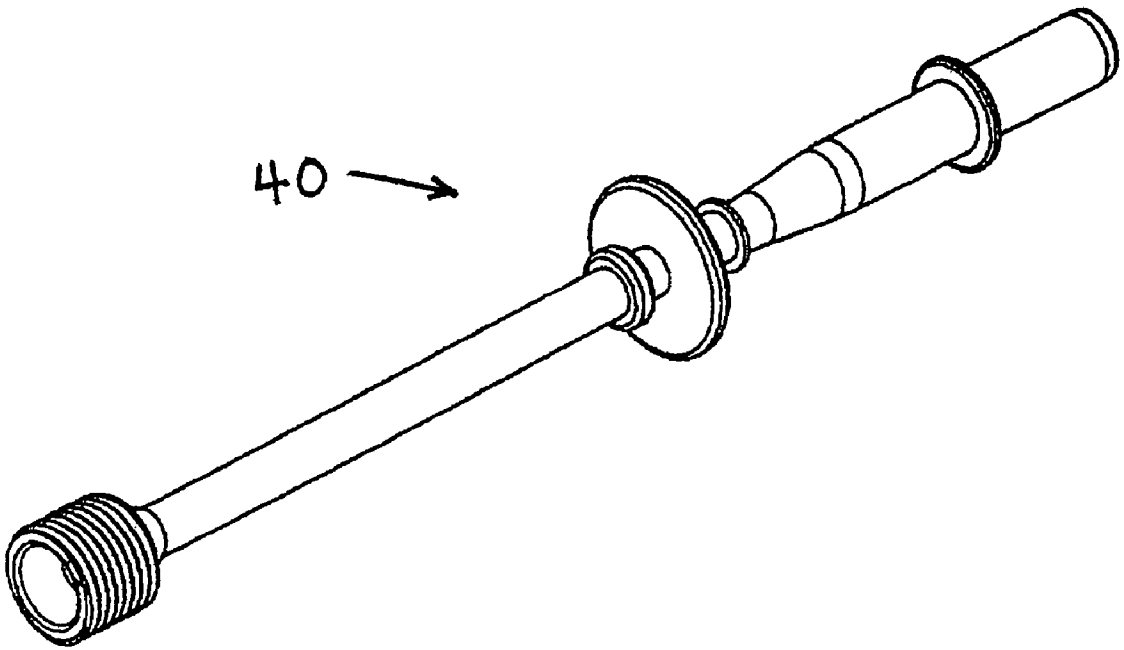
FIG. 15 is a perspective view of the barrel section of the fluid discharging apparatus.
Figure 16:
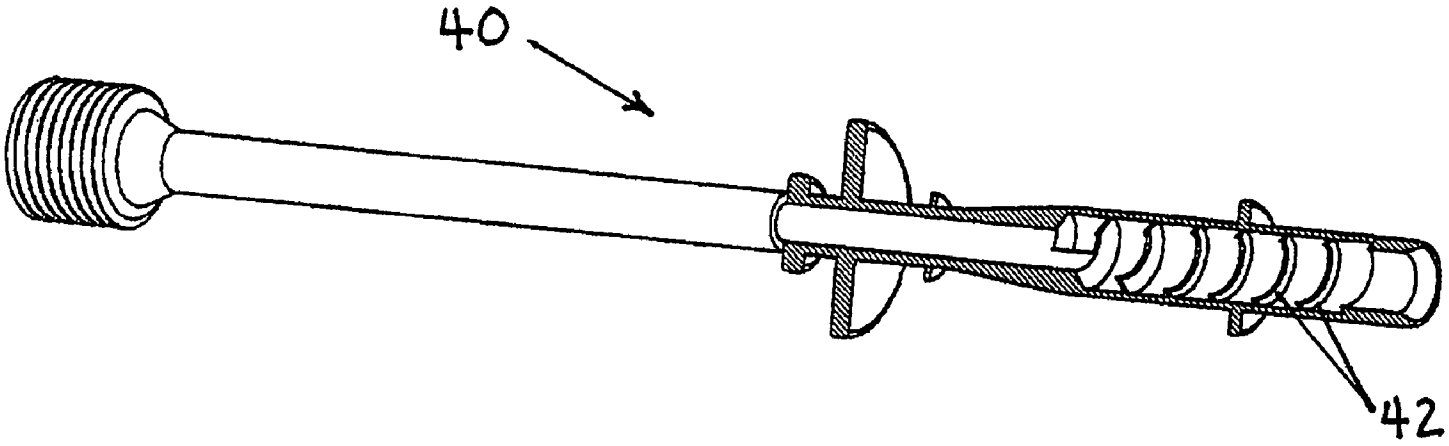
FIG. 16 is a partial cross-sectional view thereof.
Figure 17:
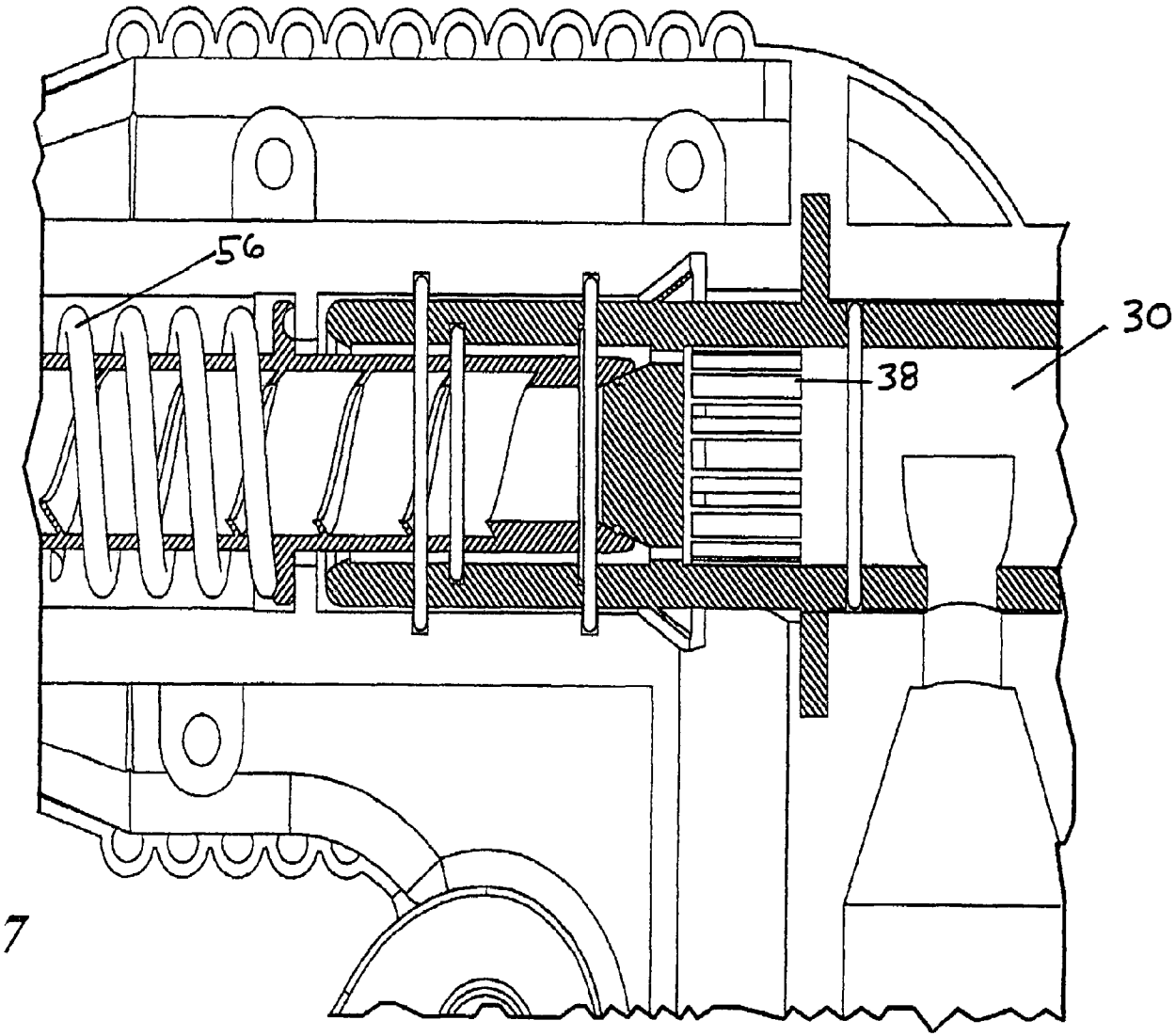
FIG. 17 is a partial cross-sectional view of the fluid discharging apparatus.
Figure 18:
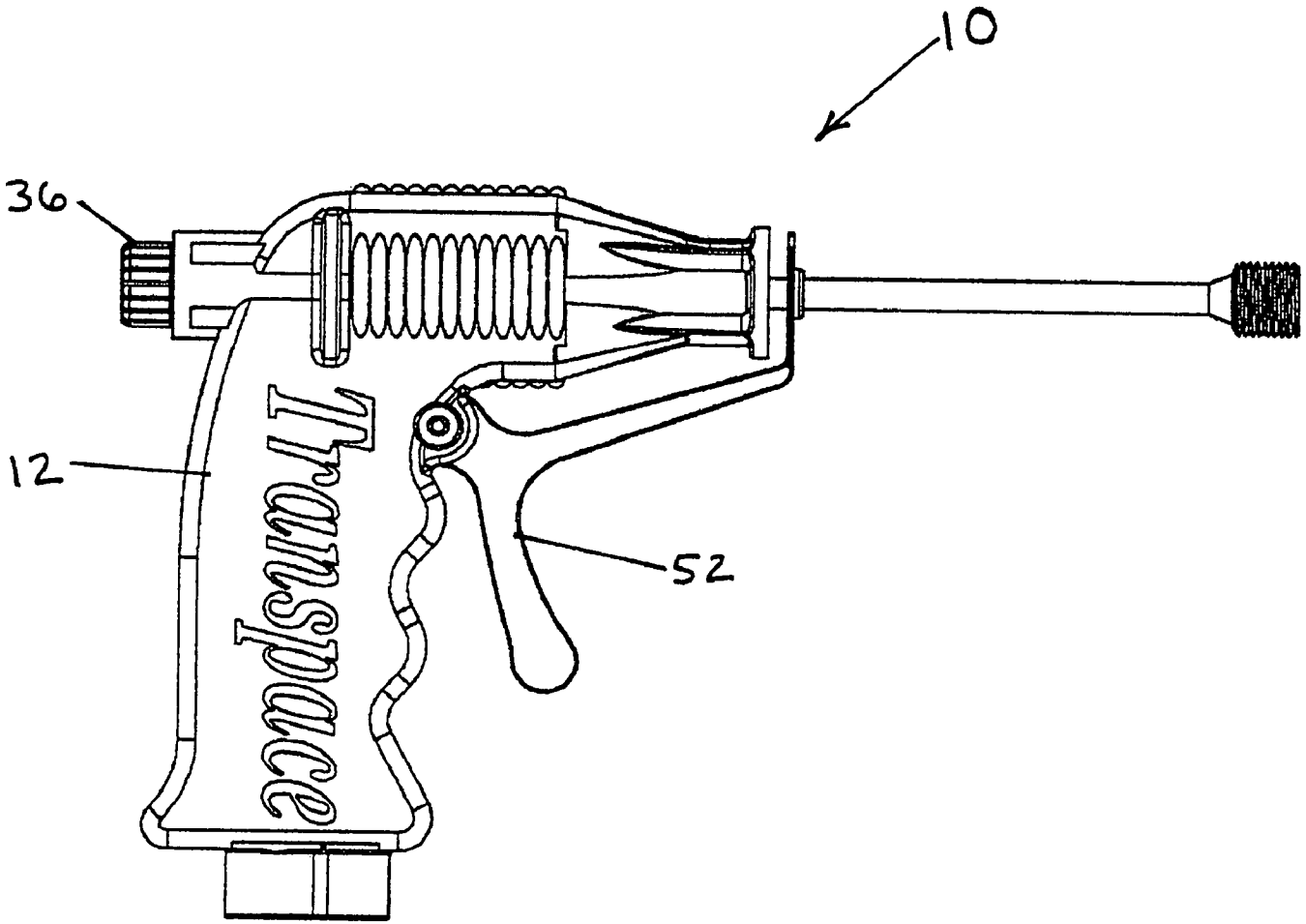
FIG. 18 is a side view of a fully assembled fluid discharging apparatus, less the nozzle.
Figure 19:
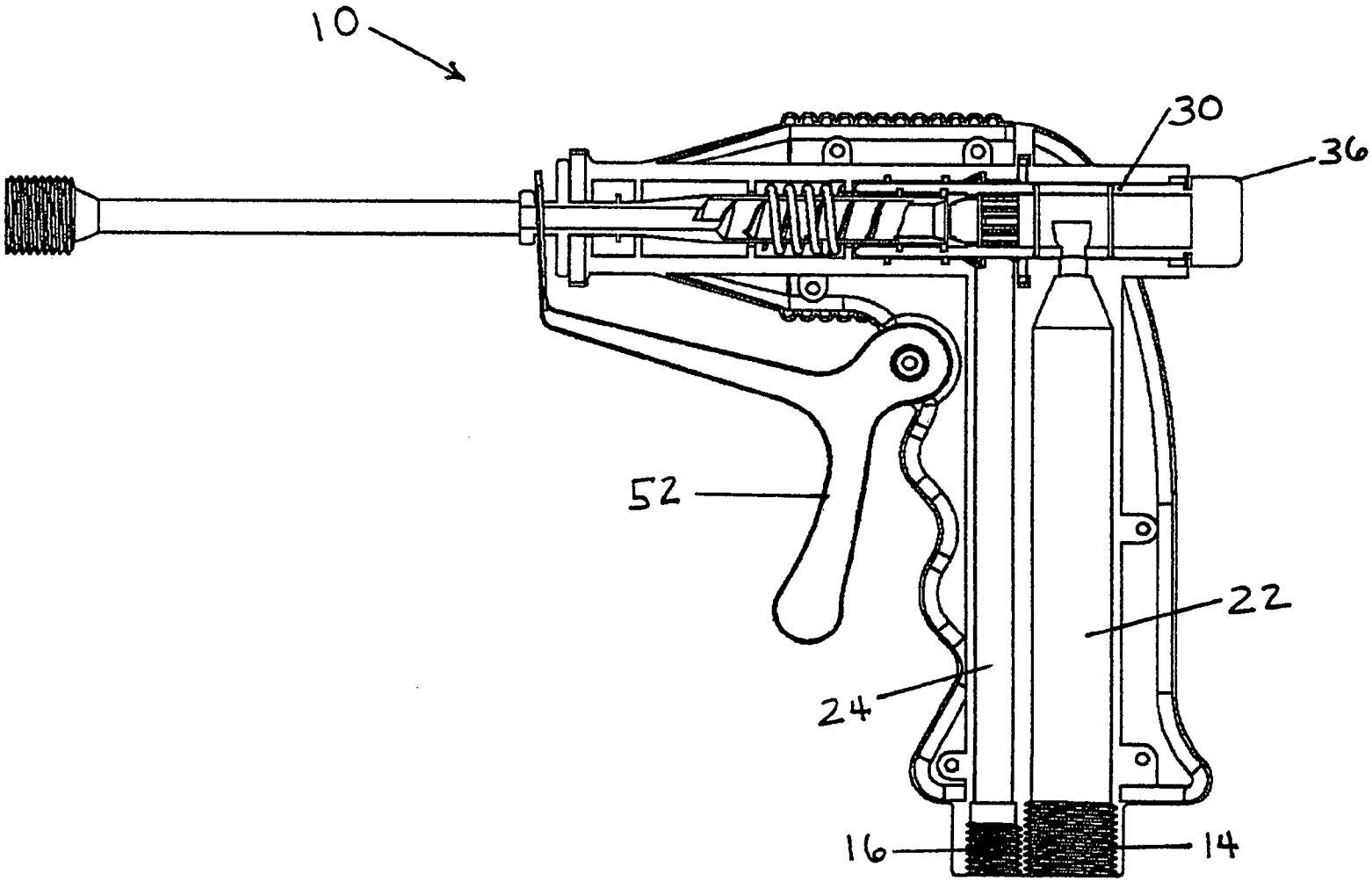
FIG. 19 is a partial sectional view thereof.
Figure 20:
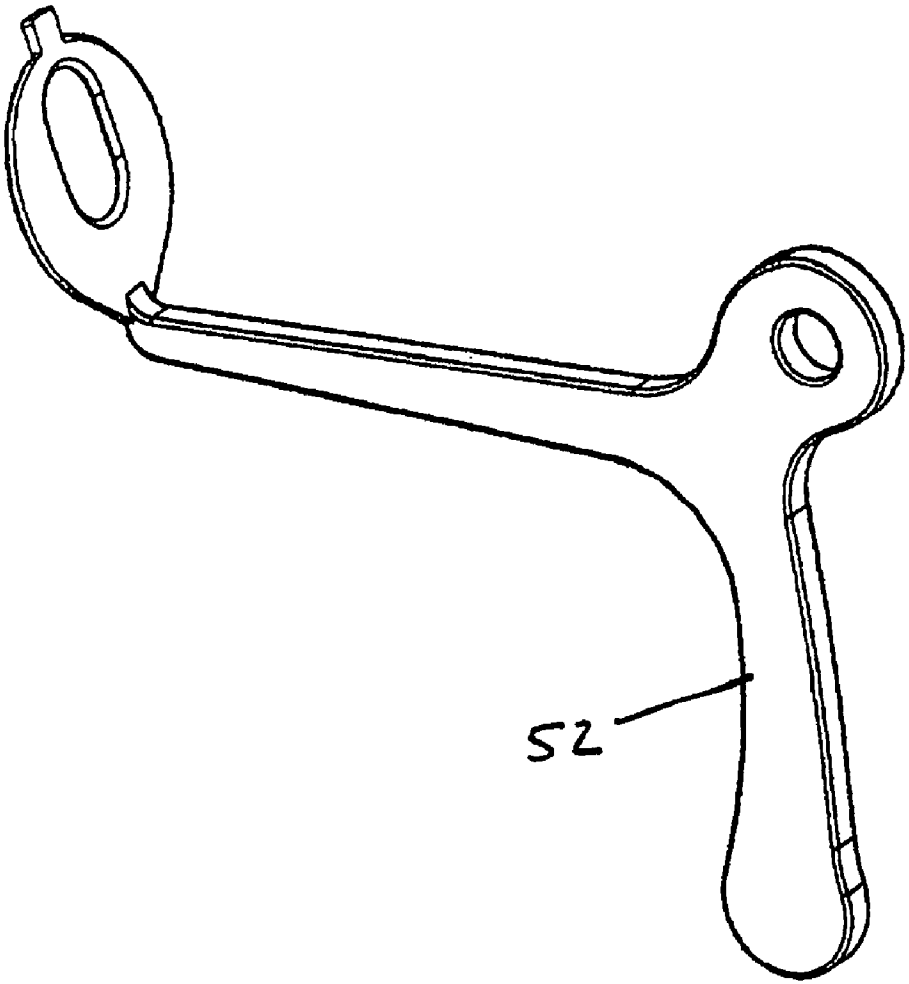
FIG. 20 is a detailed view of the flow adjusting trigger mechanism.
Figure 21:
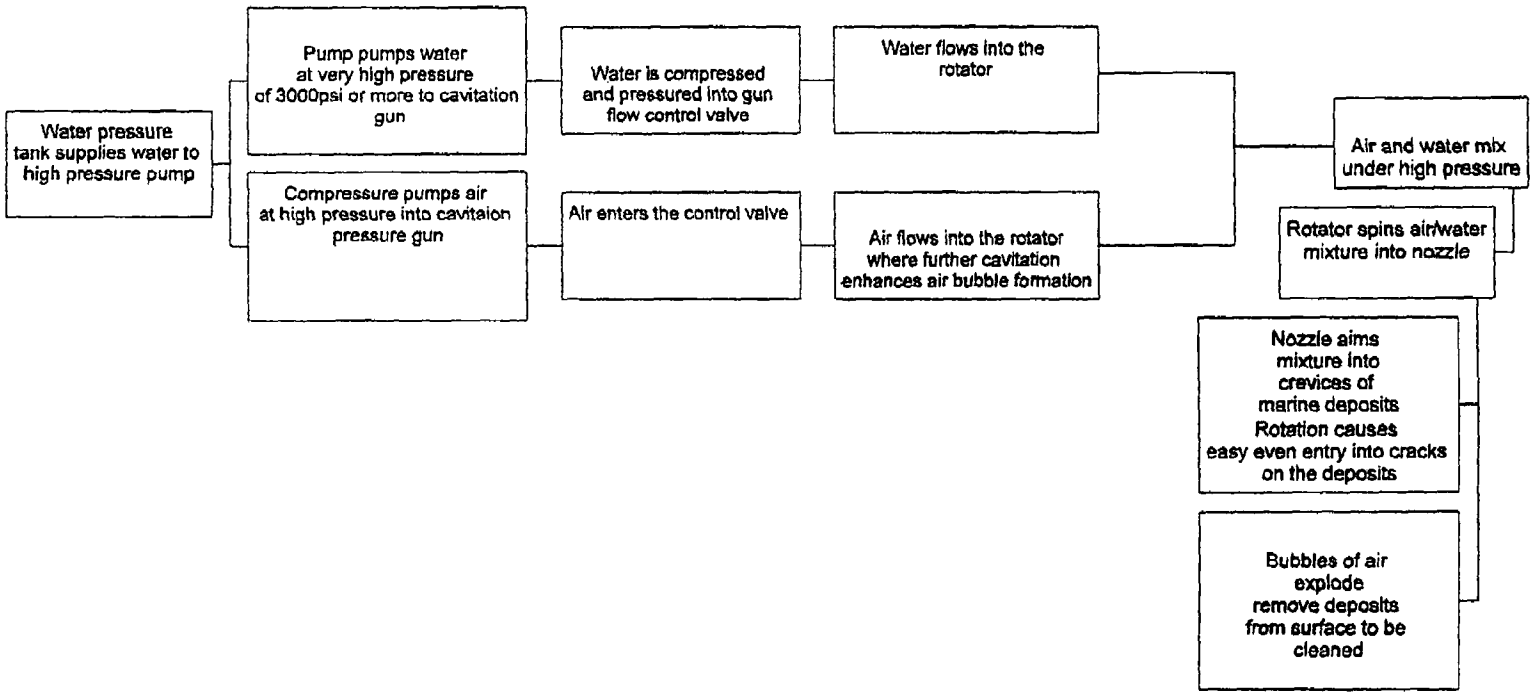
FIG. 21 is a flow chart depicting the fluid handling process.

FIG. 1 depicts hand-held hydrodynamic tools for use in removing debris from submerged surfaces using cavitating streams of pressurized fluid in accordance with the prior art. There is depicted a fluid discharge apparatus, generally referenced as 10, suitable for use in pressure cleaning. Fluid discharge apparatus 10 is adapted to commingle two fluids, preferably a pressurized liquid and a pressurized gas, and to discharge the commingle fluids in a high-pressure stream wherein the gas is disposed in the center of a stream of swirling liquid. As discussed more fully below, the pressurized stream is particularly useful in removing deposits from surfaces, and particularly useful in removing marine deposits from submerged surfaces.

As best depicted in FIGS. 1-7, fluid discharge apparatus 10 includes a pistol grip shaped housing 12 having a handle adapted with internally threaded ports, referenced as 14 and 16, for receiving first and second pressurized fluids via inlet hoses 18 and 20. In a preferred embodiment, the first and second pressurized fluids comprise water and air respectively. Pressurized water flows through water inlet hose 18 into a water inlet channel 22 defined in the handle portion of housing 12, and pressurized air flows through air inlet hose 20 into an air inlet channel 24 defined in the handle portion of housing 12.

Water inlet channel 22 terminates in communication with an adjustable water flow regulator assembly 30. In a preferred embodiment, water flow regulator assembly 30 includes a generally hollow cylindrical member 32 having a wall defining a circumferential slotted opening 34 through which water may flow. Slotted opening 34 defines an opening area that originates at a first circumferential point and expands toward termination at a second circumferentially spaced point. Cylindrical member 32 is adjustable by rotation thereof, and includes a rotatable knob 36 disposed external to housing 12 for enabling user adjustment of the water flow rate. Rotation of knob 36 positions cylindrical member 32, and particularly slotted opening 34, relative to water inlet channel 22 such that the flow rate of water is regulated based on the size slotted opening disposed in aligned communication with water inlet channel 22. Flow regulator assembly 30 further includes a plurality of circumferentially disposed apertures, referenced as 38, aligned with air inlet channel 24 so as to allow for the commingling of pressurized air and water.

The flow regulator assembly has an outlet in communication with a rotational flow-inducing barrel 40. Barrel 40 is a generally tubular member that functions as a conduit for the commingled fluid. Barrel 40 has an inner wall defining radially inwardly projecting spiral baffles, referenced as 42. A significant aspect of the present invention relates to the use of the spiral baffle structure to induce rotational flow in the fluids (e.g. liquid and gas) flowing therethrough. More particularly, spiral baffles 42 function to cause commingled liquid and gas (e.g. water and air) to flow in a spiral path while traveling through barrel 40. By causing the fluids to flow in a spiral path an axial region of low pressure is formed which draws gas bubbles into the axial region. In addition, causing the flow to swirl maximizes commingling of the fluids such that the liquid becomes saturated with gas. Consequently, a composite stream is formed with water (saturated with air) existing at the periphery of the stream and air bubbles existing in the center region of the stream. The spiral flow thereby creates an axial region of low pressure which draws the gas radially inward resulting in a composite stream including a rotating stream of liquid surrounding a concentrically disposed stream of gas. The composite stream is discharged from the apparatus through a nozzle 50.

A trigger, referenced as 52, functions to vary the flow rate of the discharge stream. In a preferred embodiment, trigger 52 has a connection point that is pivotally connected to housing 12, and an end 54 that is connected to barrel 40. Barrel 40 includes a spring 56 that biases the barrel into sealing engagement with the flow regulator assembly 30 in a configuration wherein flow is shut off. User actuation of trigger 52 moves barrel 40 away from regulator assembly 30 thereby allowing the pressurized liquid and gas to enter barrel 40 whereafter the commingled fluid stream is discharged from nozzle 50.

As best depicted in FIGS. 8-11, the present invention is particularly useful in removing marine debris from submerged surfaces. In a preferred embodiment, pressurized water and air are supplied to the fluid discharge apparatus by hoses connected to a suitable pressure source, such as a pump and/or compressor. When used in a submerged environment, fluid discharge apparatus 10 may be operated underwater by a diver. It has been found that the commingled stream of fluids produced by the apparatus is particularly effective in removing debris on submerged surfaces as the gas component of the discharged stream literally explodes upon contacting the surface thereby removing surrounding debris.

Figure 22:
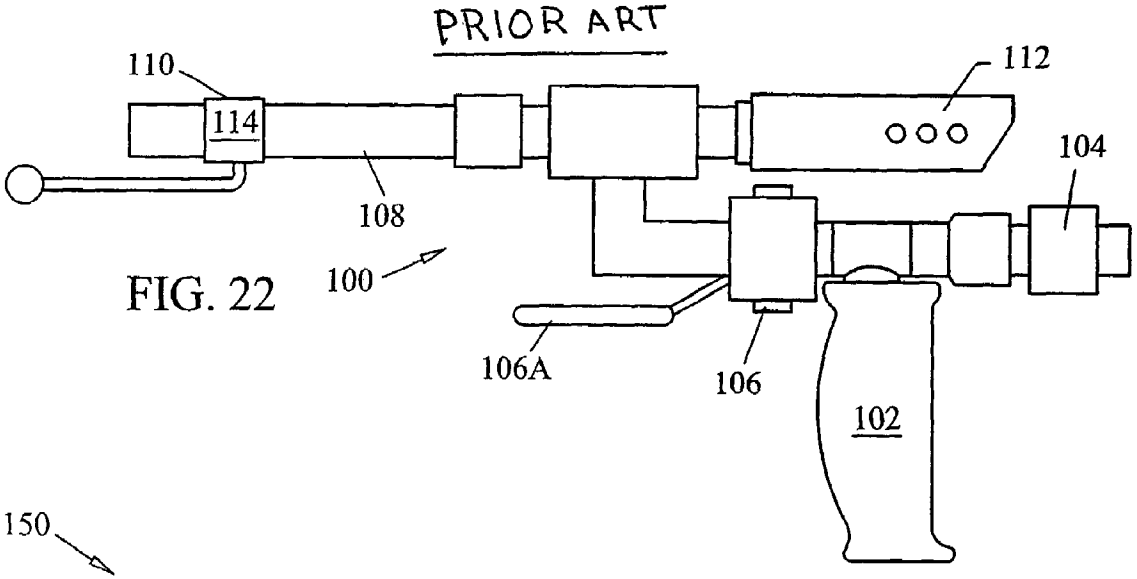
FIG. 22 shows a hand-held apparatus for cleaning debris from submerged surfaces by discharging a cavitating fluid stream according to the prior art.

With reference now FIG. 22 there is depicted a hand-held apparatus, referenced as 100, for cleaning debris from submerged surfaces by discharging a cavitating fluid stream according to the prior art. This apparatus is disclosed in Russian patent publication No. 29,026, and includes a handle 102, an pressurized fluid inlet 104 connected to the handle, a manually actuated valve 106, and a barrel 108 connected downstream of valve 106. Valve 106 functions to regulate flow through the device and is manually actuated by a projecting lever 106A. Barrel 108 includes a forward discharge end 110 and a rearward discharge end 112. Forward discharge end 110 is adapted with a cavitation generating internal chamber section 114, that functions to generate cavitation in pressurized fluid flowing therethrough such that gas bubbles are formed prior to discharge from discharge end 110. Rearward discharge end 112 allows a portion of the pressurized fluid flowing through barrel 108 to be discharged reawardly to produce reverse thrust that assists the underwater operator in maintaining hand-held apparatus 100 in a the desired position and orientation by counteracting thrust produced by the cavitating fluid stream discharged from the forward discharge end 110 when in use.

Prior art hand-held apparatus 100, however, is burdened by a number of significant disadvantages that inhibit easy and effective use of the device by a diver while underwater. More particularly, manual actuation of flow regulating valve 106 by manipulation of lever 106A, requires the use of two hands and thus has proven awkward and difficult for the user. The difficulties are compounded because the user is often wearing a bulky diving suit and gear, and is operating the device in a harsh submerged environment. Accordingly, the prior art device fails to provide effective fluid control. A further limitation of the prior art apparatus 100 relates to the single barrel limitation. More particularly, the prior art device is limited to discharging but a single fluid, typically a cavitating stream of water. There often exists a need, however, to supplement the cavitating fluid stream by discharging either a second fluid stream or an abrasive.

Figure 23:
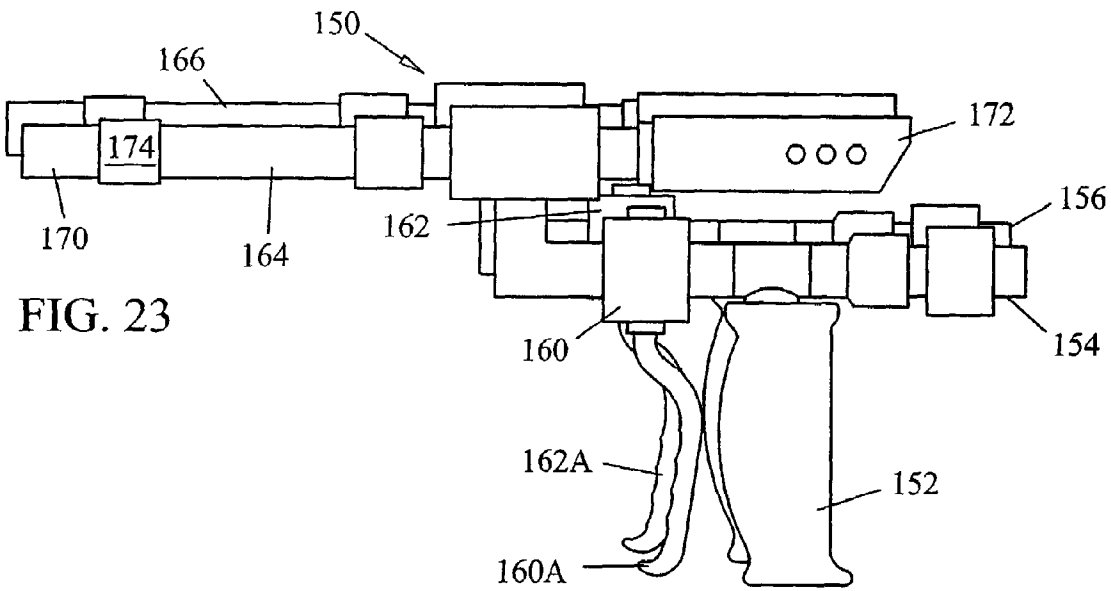
FIG. 23 shows an improved hand-held apparatus for cleaning debris from submerged surfaces by discharging cavitating fluid streams according to the present invention.

With reference now to FIG. 23 there is depicted an improved double barrel hand-held apparatus, referenced as 150, for cleaning debris from submerged surfaces by selectively discharging a first and second fluid streams, or a first fluid stream and an abrasive, such as granular material or sand. Apparatus 150 includes a handle 152, first and second pressurized fluid inlets, referenced as 154 and 156 respectively, connected to handle 152. Apparatus 150 further includes first and second trigger actuated valves 160 and 162 for controlling flow through dual barrels 164 and 166 connected downstream of valves 160 and 162. As should be apparent, valves 160 and 162 function to selectively regulate flow through the respective barrels 164 and 166. Each valve 160 and 162 includes a trigger-type manual actuator, referenced as 160A and 162A respectively. The provision of trigger actuated flow control valves allows the user to regulate flow using one hand and thus greatly improves ease of use.

Barrel 164 is fluidly connected to valve 160 and inlet 154, and includes a forward discharge end 170 and a rearward discharge end 172. Forward discharge end 170 is adapted with a cavitation generating internal chamber section 174, that functions to generate cavitation in pressurized fluid flowing therethrough such that gas bubbles are formed prior to discharge from discharge end 170. Rearward discharge end 172 allows a portion of the pressurized fluid flowing through barrel 164 to be discharged reawardly to produce reverse thrust that assists the underwater operator in maintaining hand-held apparatus 150 in a the desired position and orientation by counteracting thrust produced by the cavitating fluid stream discharged from the forward discharge end 170 when in use.

Barrel 166 is fluidly connected to valve 162 and inlet 154, and includes a forward discharge end 180, and may include a rearward discharge end 182. In a first embodiment, forward discharge end 180 may be adapted with a cavitation generating internal chamber section 184, that functions to generate cavitation in pressurized fluid flowing therethrough such that gas bubbles are formed prior to discharge from discharge end 180. In an alternate embodiment, barrel 166 merely serves as a conduit for discharging a secondary substance, such as a granular material. Rearward discharge end 182 may further be adapted with a rear discharge such that a portion of the pressurized fluid flowing through barrel 166 may be discharged reawardly to produce reverse thrust that assists the underwater operator in maintaining hand-held apparatus 150 in a the desired position and orientation by counteracting thrust produced by the cavitating fluid stream discharged from the forward discharge end 180 when in use. However, in an embodiment wherein a granular material is discharged from end 180, it is contemplated that rear discharge outlet 182 may be eliminated. Discharge end 180 may be oriented toward discharge end 170 of barrel 164 so as to inject an abrasive substance, such as sand, into the cavitating stream discharged from barrel 164 so as to enhance cleaning effectiveness.

Figure 24:
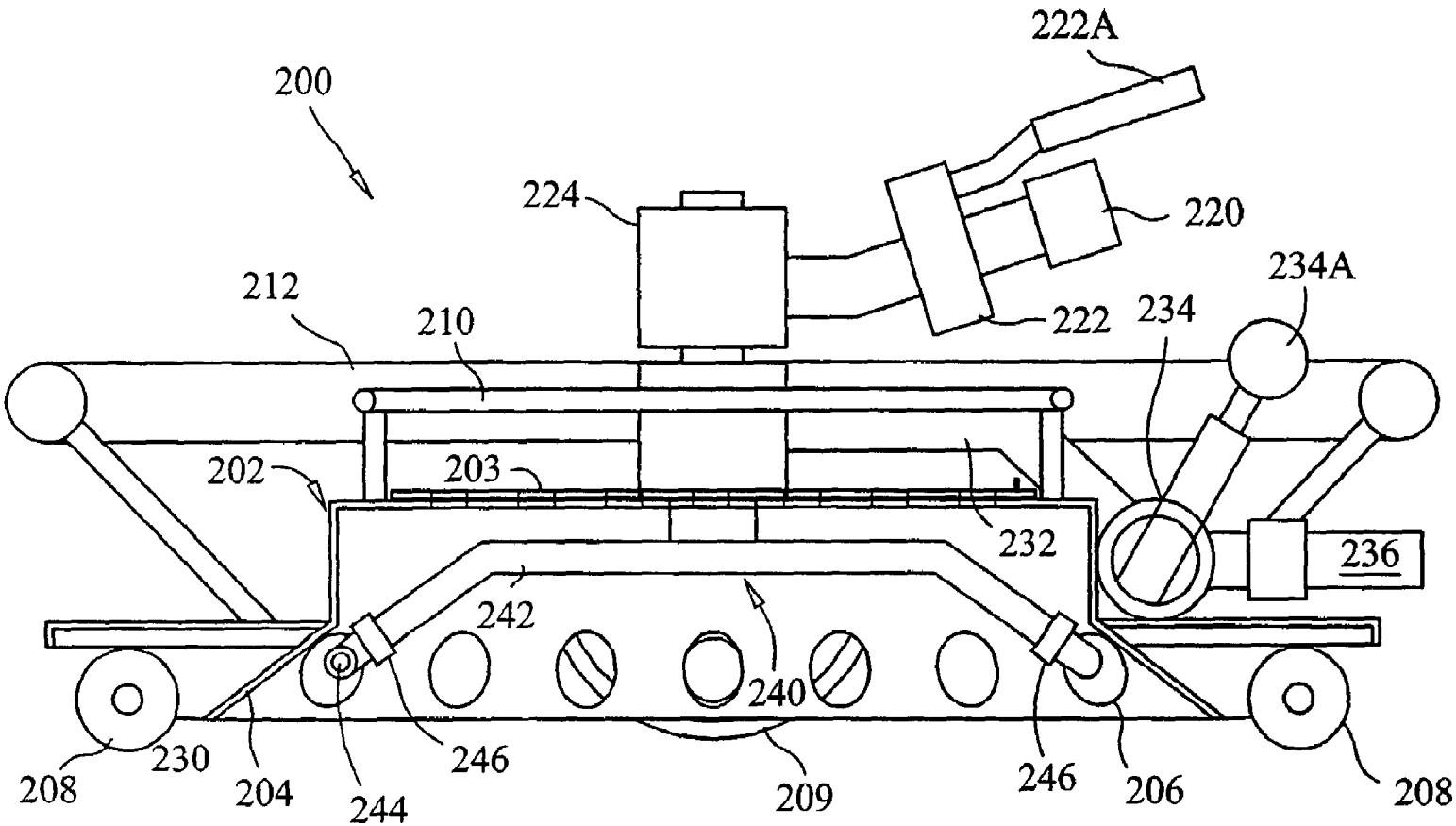
FIG. 24 Prior Art
FIG. 24 shows a side sectional view of a wheeled apparatus for cleaning debris from submerged surfaces according to the prior art.

FIG. 24 depicts a side sectional view of the wheeled embodiment apparatus 200 disclosed in the prior art. Wheeled apparatus 200 include a main body 202 including an upper deck 203 and depending skirt 204 defining a plurality of apertures 206 therein. Upper deck 203 includes a plurality of openable and closeable vent apertures 205. The opening of vent apertures 205 provides an inlet for surrounding water thereby reducing the suction effect generated during operation, while the closing of vent apertures 205 increases the suction effect for maintaining apparatus 200 in contact with the submerged surface. A significant disadvantage with the apparatus, however, relates the difficulty experience by the diver in opening and closing the vent apertures. Body 202 further includes wheels 208 and 209 adapted for rotating engagement on a submerged surface when in use. Projecting upwardly from body 202 are concentrically disposed inner and outer annular members, referenced as 210 and 212, which provide grasping structures for the diver/user to facilitate manipulating the device.

The fluid handling component structure of the prior art device includes an inlet 220 adapted for connection to a hose that functions as a conduit for a pressurized fluid. Inlet 220 is in fluid communication with a manually actuated valve 222 having a lever-type valve handle 222A. Valve 222 is in fluid communication with a vertically disposed, axial fluid conduit 224 attached to body 202. Axial fluid conduit 224 includes first and second outlets, referenced as 230 and 240 respectively.

Outlet 230 is disposed on the upper surface of body 202 and includes a conduit 232 connected to axial fluid conduit 224, a manually actuated valve 234, and a conduit 236 terminating in an outlet connected to valve 234. Outlet 230 functions to discharge a portion of the fluid flowing through axial fluid conduit 224 in a direction substantially parallel to the submerged surface upon which apparatus is in rolling engagement with. The fluid discharged from outlet 230 produces thrust that propels apparatus 200 along the submerged surface to be cleaned. The operator controls the thrust level, from minimum to maximum, using lever 234A on valve 234. A significant disadvantage present with apparatus 200 relates to the awkward positioning of lever 234A, which requires the diver to remove one hand from the apparatus simply to manipulate the lever and resulting thrust.

Outlet 240 is fluidly connected to axial fluid conduit 224 within the area bounded by body 202, and particularly below upper deck 203. Outlet 240 includes a rotating conduit 242 terminating in oppositely oriented outlets 244 and cavitation generating chamber sections 246. Cavitation generating chamber sections 246 function to produce a cavitating fluid flow prior to discharge via outlets 244 by provision of a rapidly expanding internal volume. As should be apparent, fluid flow is controlled by the diver using handle 222A on valve 222.

Figure 25:
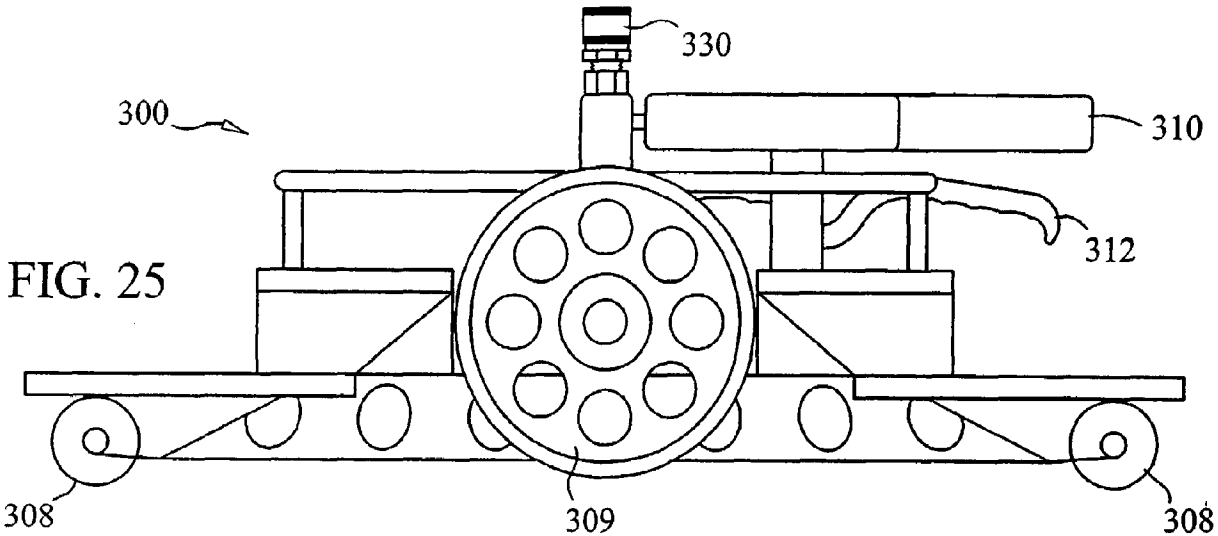
FIG. 25 shows a side view of an improved wheeled apparatus for cleaning debris from submerged surfaces according to the present invention.
Figure 26:
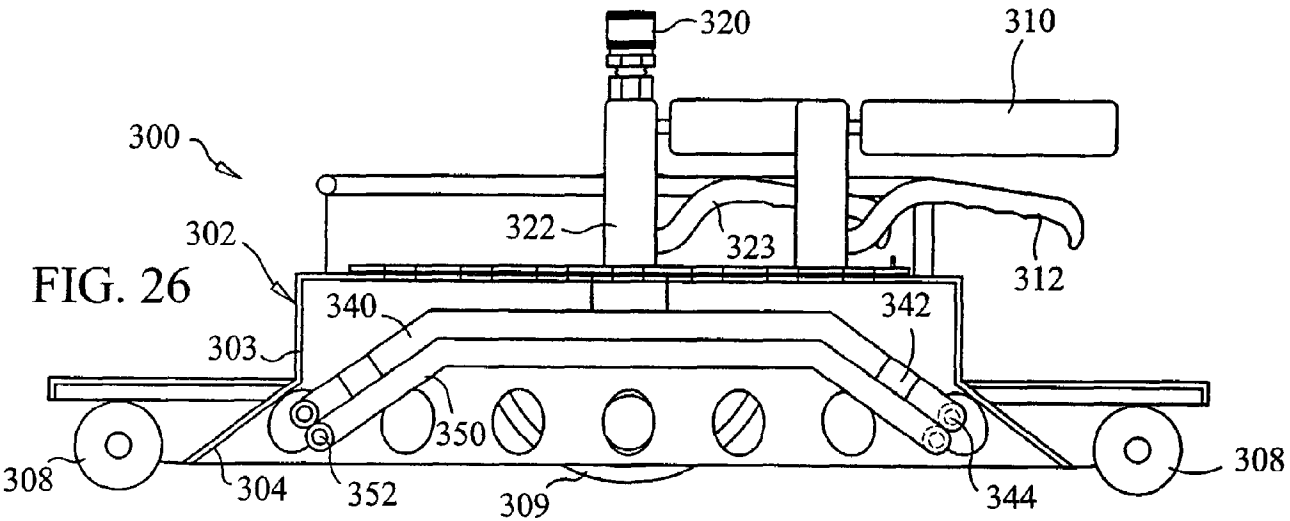
FIG. 26 shows a side sectional view thereof.
Figure 27:
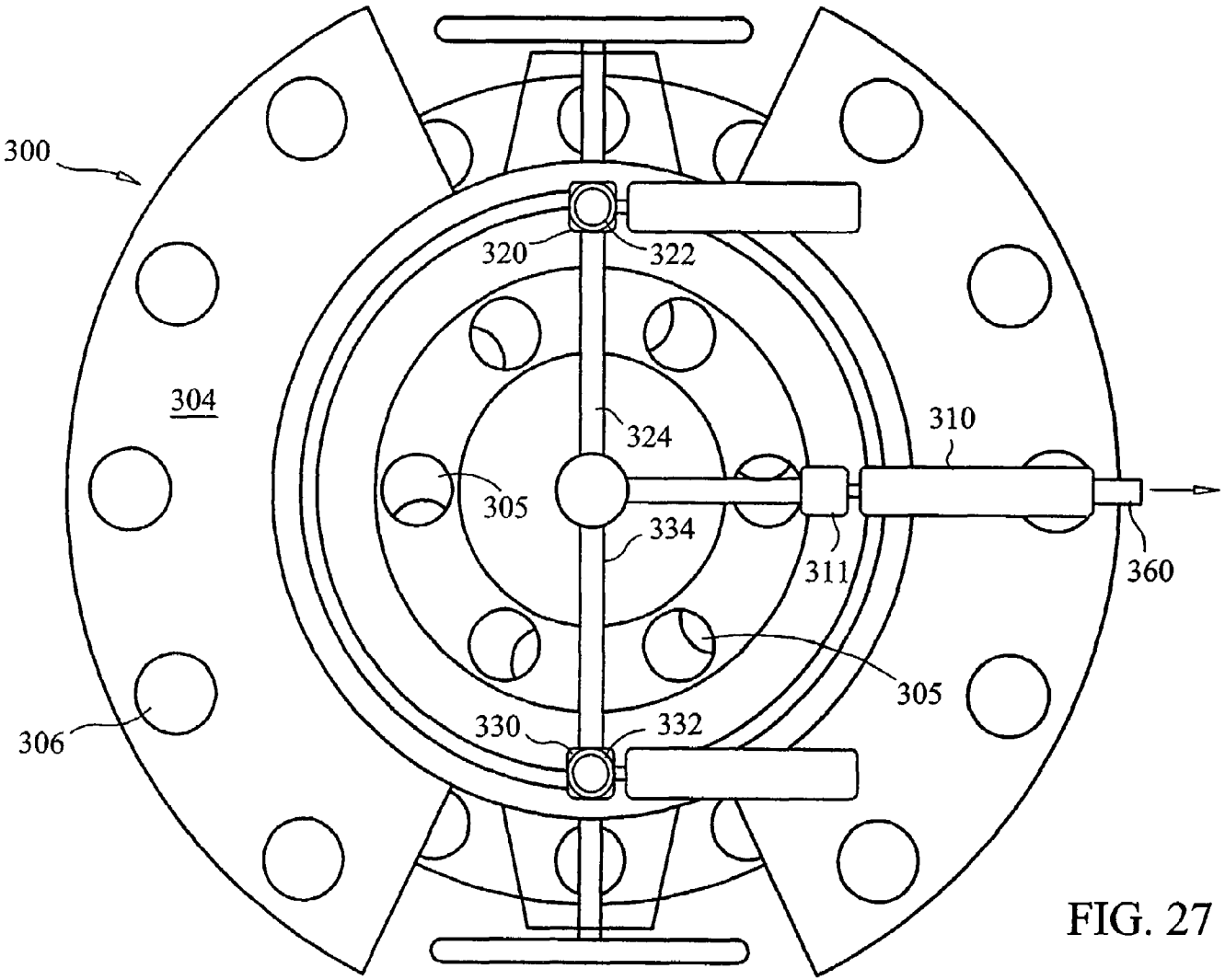
FIG. 27 shows a top view thereof.

With reference to FIGS. 25-27 there is depicted an improved wheeled cavitation cleaning apparatus, generally referenced as 300, according to the present invention. Wheeled apparatus 300 includes a main body 302 including an upper deck 303 and depending skirt 304 defining a plurality of peripheral apertures 306 therein. Body 302 further includes wheels 308 and 309 adapted for rotating engagement on a submerged surface when in use.

Upper deck 303 includes a plurality of openable and closeable vent apertures 305. The opening of vent apertures 305 provides an inlet for surrounding water thereby reducing the suction effect generated during operation, while the closing of vent apertures 305 increases the suction effect for maintaining apparatus 300 in contact with the submerged surface. A significant improvement in the apparatus of the present invention over the prior art apparatus relates to the provision of a control handle, referenced as 310, having a mechanical linkage to the closure structure for vent apertures 305. More particularly, the present invention includes providing a combination handle 310 including a lever actuator 312 that is mechanically connected to the closure structure for vent apertures for selectively opening and closing the vent apertures thereby decreasing and increasing the suction effect respectively. Lever actuator 312 is preferably biased to away from handle 310 in a position corresponding to an closed configuration for vent apertures 305. In an alternate embodiment, control may be accomplished by rotation of handle 310 in lieu of the lever actuation. Accordingly, the diver may adjust the suction pressure, without releasing his grip, by simply pulling in on the lever (or alternately by rotation of the handle) to selectively reduce or increase the suction effect.

The fluid handling component structure of the cavitation cleaning apparatus of the present invention includes first and second inlets 320 and 330. Each inlet is adapted for connection to a hose (not shown) that functions as a conduit for a pressurized fluid or other substance. In a preferred embodiment, inlet 320 is connected to a hose containing pressurized fluid, such as water, and inlet 330 is connected to a hose containing a pressurized abrasive substance, such as sand or any other suitable substance. Inlet 320 includes a manually actuated valve 322 actuated by a lever-type valve handle 323. Valve 322 is in fluid communication with a fluid conduit 324 attached to body 302 and routed axially through body 302 as best depicted in FIG. 27. Similarly, inlet 330 includes a manually actuated valve 332 actuated by a lever-type valve handle 333, or alternatively by rotation of the handle. Valve 332 is in fluid communication with a fluid conduit 334 attached to body 302 and routed axially through body 302. Fluid conduit 324 is connected to an outlet conduit 340, and fluid conduit 334 is connected to an outlet conduit 350. Outlet conduit 340 includes dual opposing outlets 344 and corresponding dual cavitation generating chambers 342 for producing a cavitating flow that is discharged from discharge outlets 344. In addition, fluid conduit 334 is in communication with outlet conduit 350 and dual discharge outlets 352. Accordingly, the present invention provides outlets for discharging two different media, such as a cavitating stream of pressurize fluid from outlets 344, and a secondary substance, such as sand or the like, from outlets 352. The dual outlets and combined substances provide enhanced cleaning effectiveness.

In addition, the present invention contemplates a third handle and valve assembly for controlling thrust. More particularly, apparatus 300 and particularly handle 310 may be further adapted to control thrust. In one embodiment, handle 300 may include a secondary control such as a rotatable grip, similar to that found on a motorcycle, that controls thrust via discharge outlet 360. Thus, rotation of handle 310 actuates a flow control 311 valve having an inlet in communication with pressurized fluid, such as conduit 324.

Figure 28:
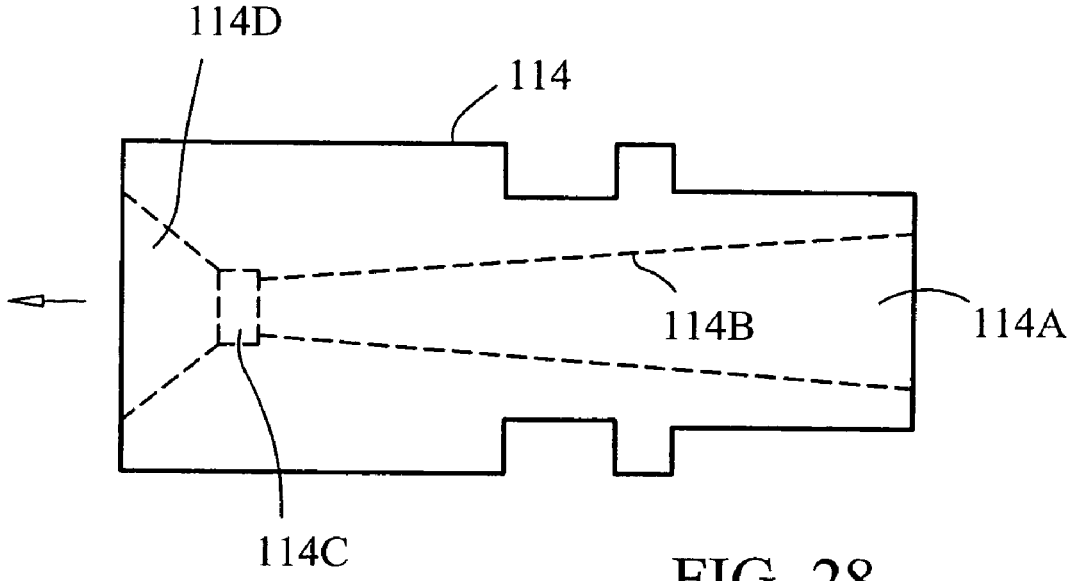
FIG. 28 Prior Art
FIG. 28 shows a cavitation generating chamber according to the prior art.

FIG. 28 depicts a detailed view of a cavitation generating chamber 114 known for use with the prior art. As seen in FIG. 28, pressurized fluid enters chamber 114 through an inlet 114A wherein converging walls 114B increase the flow rate until the fluid encounters an intermediate section 114C having a uniform diameter, and then a section having diverging walls 114D, whereby the fluid transitions to a cavitating flow state.

Figure 30:
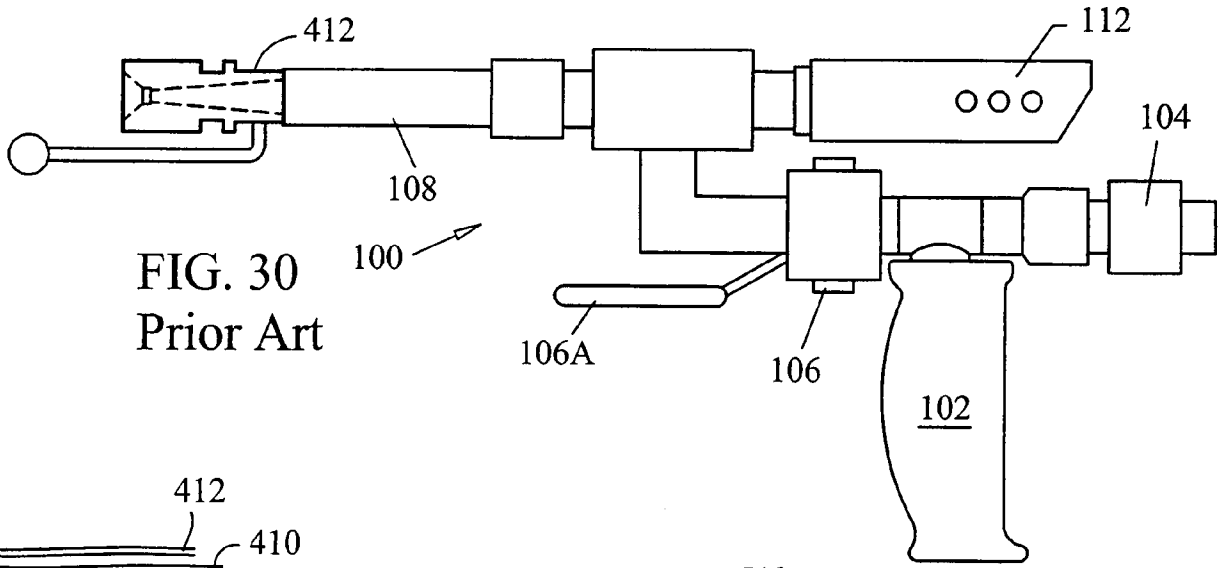
FIG. 30 Prior Art
FIG. 30 shows a hand-held apparatus for cleaning debris from submerged surfaces by discharging a cavitating fluid stream according to the prior art.

With reference now to FIG. 30 there is depicted a hand-held apparatus according to the prior art, referenced as 100, for cleaning debris from submerged surfaces by discharging a cavitating fluid stream according to the prior art. This apparatus is disclosed in Russian patent publication No. 29,026, and includes a handle 102, an pressurized fluid inlet 104 connected to the handle, a manually actuated valve 106, and a barrel 108 connected downstream of valve 106. Valve 106 functions to regulate flow through the device and is manually actuated by a projecting lever 106A. Barrel 108 includes a forward discharge end 110 and a rearward discharge end 112. Forward discharge end 110 is adapted with a cavitation generating internal chamber section 114 as shown in FIG. 28, that functions to generate cavitation in pressurized fluid flowing therethrough such that gas bubbles are formed prior to discharge from discharge end 110. Rearward discharge end 112 allows a portion of the pressurized fluid flowing through barrel 108 to be discharged reawardly to produce reverse thrust that assists the underwater operator in maintaining hand-held apparatus 100 in a the desired position and orientation by counteracting thrust produced by the cavitating fluid stream discharged from the forward discharge end 110 when in use.

Figure 29:
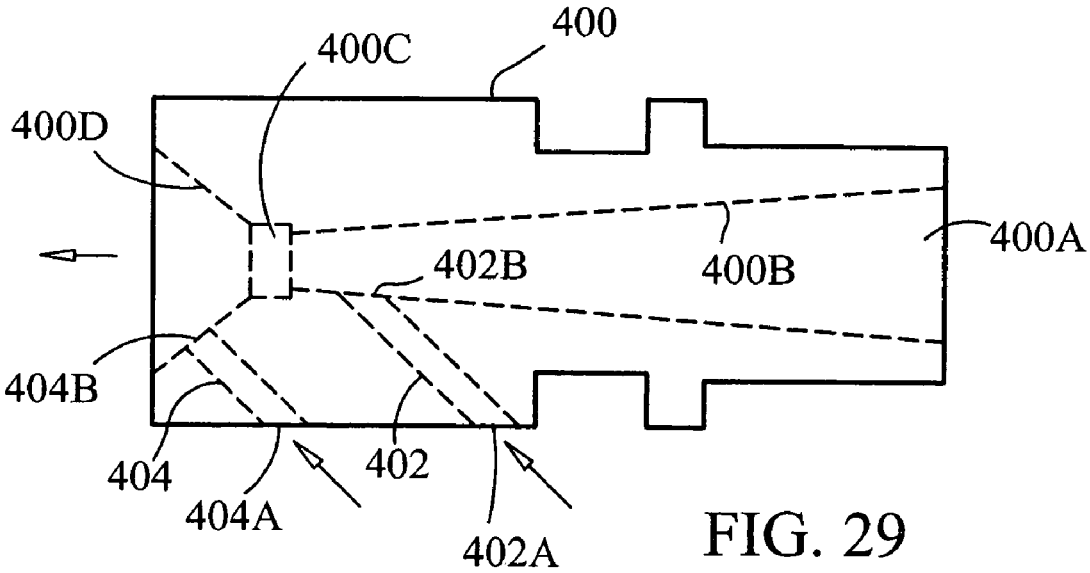
FIG. 29 shows a cavitation generating chamber with first and second auxiliary input channels for feeding secondary fluids or substances in accordance with the present invention.

Turning now to FIG. 29, there is depicted an improved cavitation generating chamber according to the present invention, referenced as 400. Cavitation chamber 400 may be defined within a body fabricated from metal, such as bronze, ceramic, or any other suitable material. Cavitation generating chamber 400 includes an inlet 400A wherein converging walls 400B increase the flow rate until the fluid encounters an intermediate section 400C having a uniform diameter, and then a section having diverging walls 400D, whereby the fluid transitions to a cavitating flow state. A significant aspect of the present invention, however, relates to the addition of first and second auxiliary input channels, referenced as 402 and 404 respectively. More particularly, the present invention includes a first auxiliary input channel 402 formed as a through bore having an inlet 402A defined by the chamber outer wall and an outlet 402B in communication with the chamber interior, more particularly the converging wall section 400B. In a preferred embodiment, the first auxiliary input channel 402 may be in communication with a source of compressed gas, or alternatively with any other suitable substance, such as fire suppressing foam. The substance introduced through channel 402 is introduced into a fluid stream prior to transition into a cavitating state. The present invention further includes a second auxiliary input channel 404 formed as a through bore having an inlet 404A defined by the chamber outer wall and an outlet 404B in communication with the chamber interior, more particularly the diverging wall section 400D. In a preferred embodiment, the second auxiliary input channel 404 may be in communication with a source of abrasive material or any other suitable substance. The substance introduced through channel 404 is introduced into a fluid stream after transition to a cavitating state.

Figure 31:
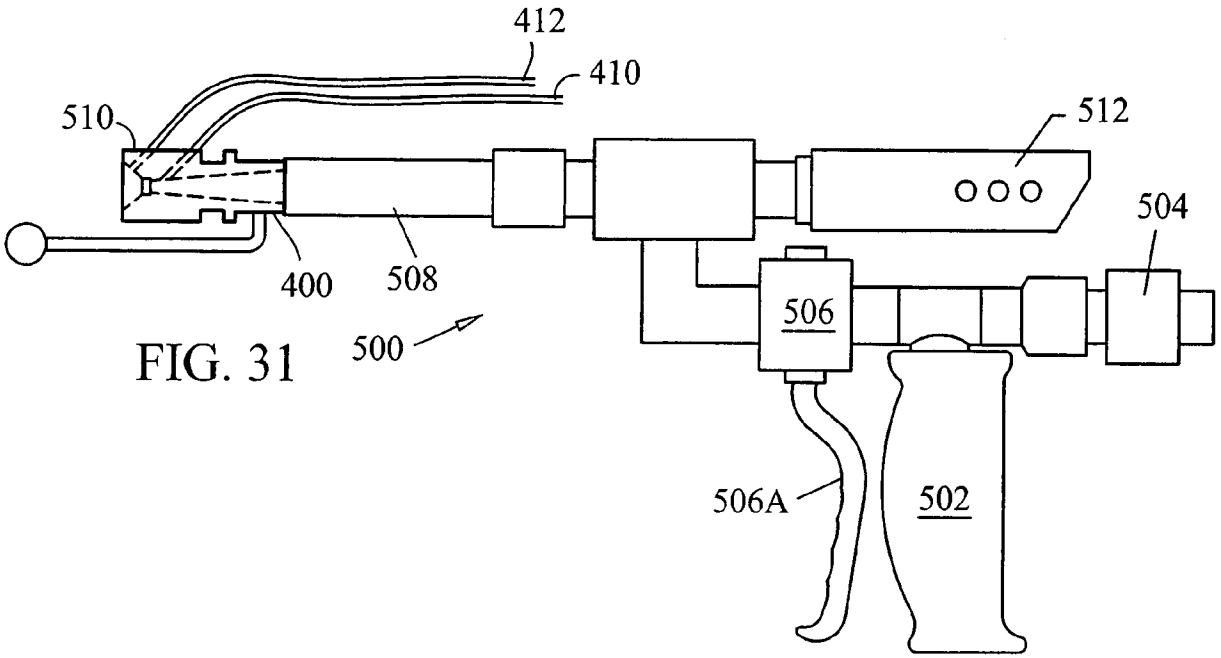
FIG. 31 shows a hand-held apparatus for cleaning debris from submerged surfaces by discharging a cavitating fluid stream using a cavitation generating chamber adapted with first and second auxiliary channels according to the present invention.

Turning now to FIG. 31, there is depicted a hand-held cleaning apparatus adapted with an improved cavitation generating chamber with first and second auxiliary input ports, referenced as 500, for cleaning debris from submerged surfaces by discharging a cavitating fluid stream with the option of one or more fluids or substances introduced through the auxiliary input ports to enhance cleaning effectiveness. Accordingly, the improved hand-held apparatus includes a handle 502, an pressurized fluid inlet 504 connected to the handle, a manually actuated valve 506, and a barrel 508 connected downstream of valve 506. Valve 506 functions to regulate flow of the primary working fluid through the device and is manually actuated by a projecting lever 506A. Barrel 508 includes a forward discharge end 510 and a rearward discharge end 512. Forward discharge end 510 is adapted with a cavitation generating internal chamber section 400 as shown in FIG. 29, that functions to generate cavitation in pressurized fluid flowing therethrough such that gas bubbles are formed prior to discharge from discharge end 510. First auxiliary input port 402 is preferably in fluid communication with a source of compressed gas or other suitable substance, such as fire foam, by a tubular conduit 410. Similarly auxiliary input port 404 is preferably in fluid communication with a source of abrasive material by a tubular conduit 412. Rearward discharge end 512 allows a portion of the pressurized fluid flowing through barrel 508 to be discharged reawardly to produce reverse thrust that assists the underwater operator in maintaining hand-held apparatus 500 in a the desired position and orientation by counteracting thrust produced by the cavitating fluid stream discharged from the forward discharge end 110 when in use.

As should be apparent, improved cavitation generating chamber 400 is equally adaptable for use with a wheeled cleaning apparatus, such as the apparatus shown in FIGS. 24-27. The present invention provides improvements in the art of cleaning debris from submerged surfaces, and particularly improves upon the control of such devices with controls that allow the diver/operator to adjust flow rates and thrust without releasing his grasp, while improving cleaning effectiveness by providing controllable dual flow outlets and the use of abrasive substances.

Figure 32:
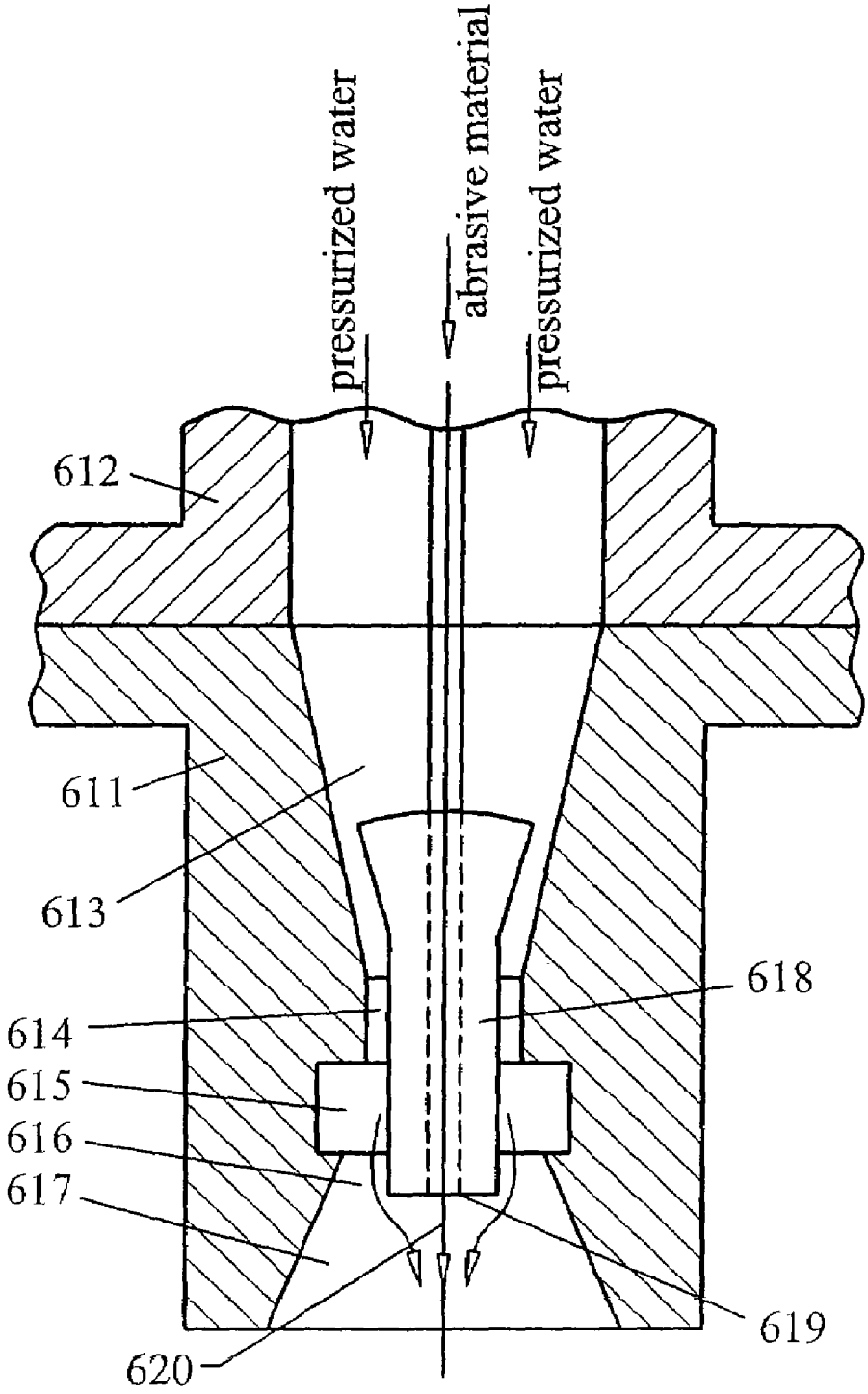
FIG. 32 discloses an alternate cavitation generating chamber containing a flow channel made with coaxial conduits to independently deliver a cavitating fluid stream and abrasive material to the surface to be cleaned.

FIG. 32 depicts an alternate embodiment coaxial exhaust diffuser, generally referenced as 610. The water flowing channel is developed with the coaxial exhaust diffuser, and the cone-cylindrical portion is made with the coaxial cylindrical expanded cavity, in which case the center body forms the uniform cross-section annual gap with the cone-cylindrical portion walls, and the center body's flat butt end is located at the diffuser inlet. The modulator-amplifier allows to increase the blasting efficiency when removing surface deposits from submerged surfaces and improve the efficiency of cavitations generating chamber operation. The set task fulfilled by the following: the water flowing channel is made with the coaxial exhaust diffuser, the cone-cylindrical portion—with the coaxial cylindrical expanded cavity, in which case the center body forms the uniform cross-section annual gap with the cone-cylindrical portion walls, and the center body's flat butt end is located at the diffuser inlet. The drawing (FIG. 32) schematically illustrates the cavitations generating chamber with the feed part (longitudinal section).

Housing 611 of the cavitations generating chamber spray head has feed part 612, confuser 613 located in housing 611 is coaxially connected with flowing channel 614, at the outlet of which is issued expanded cavity 615, outlet 616, which outlet is larger than the diameter of channel 614 and developed in the form of exhaust diffuser 617. Center body 618 is situated in line with housing 611 and has the uniform cross-section gap with channels 614 and 616 and flat butt end 619 located at the inlet of diffuser 617. The abrasive material that transferred through pipeline to the field 620 would be delivered to the cleaning surface separately from the area where bulbs not formed. The cavitations destroying energy would not be wasted to interfere with the abrasive blasting material.

The modulator-amplifier is operated as follows. The water under pressure is going into housing 611 through feed part 612 to confuser 613, in which an increase in transverse pulsations of fluid flow velocities takes place. After passing portion 614, the fluid flow is accelerated and enters sharply expanded cavity 615. The gas bubbles formed at the exit section 614 loose their stability and in cavity 615 gain the capability of unlimited growth. After entering the zone of increased pressure of diffuser 617, the growth of cavitations bubbles diameter stops. The bubbles containing a sufficient amount of gas after reaching the minimum radius again restore and perform several cycles of decaying oscillations. Most bubbles are transferred by the outward flow from diffuser 617 and form the zone of collection in the form of prolonged belt from the diffuser edge to the surface to be cleaned. The modulator-amplifier has produced the cavitations bubbles are formed only in a thin layer of the flow at its periphery are absent in the center part of the flow, which decreases the cleaning efficiency and increases power consumption. The development of body 618 with flat butt end 619 at the outlet of diffuser 617 allowed, due rarefaction behind flat butt end 619 to focus and uniformly distribute the stream of cavitations bubbles throughout the cross-section without leaving diffuser 617. The modulator-amplifier's design allows to obtain the detachable cavitations zone of collection of the gas bubbles that at a certain distance from the outlet of diffuser 617 determined by the pressure at the modulator nozzle edge, the nozzle diameter and the ambient static pressure collapse causing erosion destruction of depositions on the surface to be cleaned. In addition, the cavitations destroying energy would not be wasted to interfere with the abrasive blasting material, because the above material is delivering directly to the zone 620 and not interfere with the cavitations bulbs.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A hydrodynamic cleaning apparatus for removing debris from submerged surfaces using a pressurized fluid stream having cavitating flow characteristics, said apparatus comprising:

a body having a first inlet for receiving a liquid under pressure;

means for regulating the flow rate of said liquid between a minimum and maximum flow rate;

means for creating a cavitating flow state in said liquid;

said means for creating a cavitating flow state in said liquid includes a housing defining a cavitation generating chamber and a center body disposed within said chamber, said chamber bounded by an outer wall including, in the direction of flow, a first section defined by a converging wall, a second section defined by constant diameter wall of a first diameter, a third section defined by a constant diameter wall of a second diameter, with said second diameter being larger than said first diameter so as to from an expanded cavity, and a forth section defined by diverging wall terminating in an outlet for discharging a cavitating stream of liquid; and means for generating thrust by discharging at least a portion of said liquid.

2. A hydrodynamic cleaning apparatus according to claim 1, further including means for introducing a second substance into said cavitation generating chamber.

3. A hydrodynamic cleaning apparatus according to claim 2, wherein said second substance is an abrasive material.

4. A hydrodynamic cleaning apparatus for removing debris from submerged surfaces using a pressurized fluid stream having cavitating flow characteristics, said apparatus comprising:

a body having a first inlet for receiving a liquid under pressure and an second inlet for receiving a second substance under pressure;

said first inlet in fluid communication with a first manual control valve having a trigger-type actuator for regulating the flow rate of said liquid between a minimum and maximum flow rate;

said first manual control valve in fluid communication with a cavitation generating chamber having in series an inlet confuser bounded by a converging wall, a flow channel of generally uniform diameter, an expanded cavity, and an outlet bounded by a diverging wall for discharging said liquid in a cavitating flow state;

said second inlet in fluid communication with said chamber for injecting a second substance into said chamber;

said first inlet also in fluid communication with a thrust flow control valve having a thrust outlet for generating thrust using at least a portion of said liquid.

5. A hydrodynamic cleaning apparatus according to claim 4, wherein said body is a hand-held structure.

6. A hydrodynamic cleaning apparatus according to claim 4, wherein said thrust outlet is oriented approximately 180 degrees relative to said first outlet.

7. A hydrodynamic cleaning apparatus according to claim 4, wherein said body is a wheeled structure having an upper deck, said upper deck defining a plurality of vent apertures, said body including means for selectively opening and closing said vent apertures.

8. A hydrodynamic cleaning apparatus according to claim 7, wherein said means for selectively opening and closing said vent apertures includes a handle having a trigger-type actuator.

* * * * *